US008257142B2

(12) United States Patent
Muldowney et al.

(10) Patent No.: US 8,257,142 B2
(45) Date of Patent: Sep. 4, 2012

(54) CHEMICAL MECHANICAL POLISHING METHOD

(75) Inventors: Gregory P. Muldowney, Earleville, MD (US); Ravichandra V. Palaparthi, Newark, DE (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 1177 days.

(21) Appl. No.: 12/103,232

(22) Filed: Apr. 15, 2008

(65) Prior Publication Data

US 2009/0258573 A1 Oct. 15, 2009

(51) Int. Cl.
*B24B 51/00* (2006.01)

(52) U.S. Cl. ..... 451/5; 451/41

(58) Field of Classification Search ..... 451/5, 8, 451/9, 41, 443, 444, 6, 7, 57
See application file for complete search history.

(56) References Cited

U.S. PATENT DOCUMENTS

| | | | | |
|---|---|---|---|---|
| 5,655,951 | A | 8/1997 | Meikle et al. | |
| 5,736,463 | A * | 4/1998 | Sato | 438/692 |
| 5,934,974 | A | 8/1999 | Tzeng | |
| 6,045,434 | A | 4/2000 | Fisher, Jr. et al. | |
| 6,194,231 | B1 | 2/2001 | Ho-Cheng et al. | |
| 6,736,709 | B1 | 5/2004 | James et al. | |
| 6,783,436 | B1 | 8/2004 | Muldowney | |
| 7,081,044 | B2 * | 7/2006 | Ohta et al. | 451/59 |
| 7,235,488 | B2 | 6/2007 | Elledge | |
| 7,300,340 | B1 | 11/2007 | Elmufdi et al. | |
| 7,306,506 | B2 | 12/2007 | Elledge | |
| 7,458,885 | B1 * | 12/2008 | Palaparthi | 451/527 |
| 2007/0227901 | A1 | 10/2007 | Hu et al. | |
| 2007/0238297 | A1 | 10/2007 | Chandrasekaran et al. | |
| 2009/0093193 | A1 * | 4/2009 | Bae | 451/8 |

OTHER PUBLICATIONS

U.S. Appl. No. 11/838,954, filed Aug. 15, 2007, Palaparthi.
U.S. Appl. No. 12/103,292, filed Apr. 15, 2008, Muldowney et al.
Wang, et al., "Effects of Pad Grooves on Chemical Mechanical Planarization", J. Electrochemical Society 154 (6) H486-H494 (2007).

* cited by examiner

*Primary Examiner* — Robert Rose
(74) *Attorney, Agent, or Firm* — Thomas S. Deibert

(57) ABSTRACT

Shape memory chemical mechanical polishing methods are provided that use shape memory chemical mechanical polishing pads having a polishing layer in a densified state, wherein the polishing pad thickness and/or groove depth is monitored and the polishing layer is selectively exposed to an activating stimulus causing a transition from the densified state to a recovered state.

10 Claims, 21 Drawing Sheets

CHEMICAL MECHANICAL POLISHING METHOD

The present invention relates generally to the field of chemical mechanical polishing. In particular, the present invention is directed to methods for the chemical mechanical polishing of magnetic, optical and semiconductor substrates.

In the fabrication of integrated circuits and other electronic devices, multiple layers of conducting; semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular polishing track, or polishing region, wherein the wafer's surface directly confronts the polishing layer. The wafer surface is polished and made planar by chemical and mechanical action of the polishing layer and polishing medium on the surface.

The substrate material removal rate in a CMP process is determined by the hydrodynamic state of the contact between the rotating substrate to be processed and the polishing pad with the flowing polishing medium. The hydrodynamic state of this contact is determined by the balance between the polishing medium hydrodynamics and the contact mechanics between the polishing pad and the substrate, which balance is characterized by the inverse Sommerfeld number. Lower values of the inverse Sommerfeld number indicate hydroplaning of the substrate across the surface of the sliding polishing pad and a lower substrate material removal rate. Higher values of the inverse Sommerfeld number indicate more intimate contact between the polishing pad and the substrate and an increased substrate material removal rate. The inverse Sommerfeld number is determined by the total volume available for polishing medium per unit area within the gap between the polishing pad and the substrate during polishing.

Polishing pads often have a polishing surface with one or more grooves. Under a given set of polishing conditions, the groove volume in addition to the volume in the microtexture of the polishing pad (both per unit area) determine the inverse Sommerfeld number and the hydrodynamic state of the contact between the polishing pad and the substrate to be processed.

There are several reasons for incorporating grooves in the polishing surface of a chemical mechanical polishing pad, including: (A) to provide the necessary hydrodynamic state of the contact between the substrate being polished and the polishing pad—(if the polishing pad is either ungrooved or unperforated, a continuous layer of polishing medium can exist between the substrate and the polishing pad causing hydroplaning, which prevents uniform intimate contact between the polishing pad and the substrate and significantly reduces the substrate material removal rate); (B) to ensure that the polishing medium is uniformly distributed across the polishing surface of the polishing pad and that sufficient polishing medium reaches the center of the substrate—(this is especially important when polishing reactive metals such as copper, in which the chemical component of the polishing is as critical as the mechanical component; uniform polishing medium distribution across the substrate is required to achieve the same polishing rate at the center and edge of the substrate; however, the thickness of the polishing medium layer should not be so great as to prevent direct contact between the polishing pad and the substrate); (C) to control both the overall and localized stiffness of the polishing pad—(this controls polishing uniformity across the substrate surface and also the ability of the polishing pad to level substrate features of different heights to give a highly planar surface); and (D) to act as channels for the removal of polishing debris from the polishing pad surface—(a build-up of debris increases the likelihood of substrate scratches and other defects).

One factor determining polishing pad life for grooved polishing pads is the depth of the grooves. That is, acceptable polishing performance is possible only until the polishing pad has worn to the point where the grooves have insufficient remaining depth to effectively distribute polishing medium, remove polishing debris and prevent hydroplaning. Accordingly, it should be apparent that deeper grooves can correlate to a longer polishing pad life. Notwithstanding, there are practical limits on how deep the grooves can be. The cutting of grooves into the polishing layer effectively reduces the stiffness of the polishing layer. That is, there is some amount of movement of the lands of the grooves during polishing resulting from the pressure applied by the dynamic contact between the polishing surface and the substrate. At some point, an increase in the depth of the grooves will introduce an unacceptable amount of shearing of the lands or collapse of the groove sidewalls when the polishing pad dynamically contacts a substrate during polishing. These phenomena effectively limit the initial groove depth for a given polishing application. Moreover, deep grooves present pad cleaning challenges. Abrasives in polishing media and polishing debris tend to collect in the grooves. As the grooves become deeper, it becomes more challenging to remove polishing debris from the grooves, which can lead to increased polishing defects.

Polishing pad surface "conditioning" or "dressing" is critical to maintaining a consistent polishing surface for stable polishing performance. Over time the polishing surface of the polishing pad wears down, smoothing over the microtexture of the polishing surface—a phenomenon called "glazing". The origin of glazing is plastic flow of the polymeric material due to frictional heating and shear at the points of contact between the polishing pad and the workpiece. Additionally, polishing debris from the CMP process can clog the surface voids as well as the micro-channels through which polishing medium flows across the polishing surface. When this occurs, the polishing rate of the CMP process decreases, and can result in non-uniform polishing. Conditioning creates a new texture on the polishing surface useful for maintaining the desired polishing rate and uniformity in the CMP process.

Polishing wear and surface conditioning in conventional CMP lead to a continual decay in groove depth over time. Typical surface conditioning with a diamond disk results in a polishing pad material thickness cut rate of 10-50 microns/hour. As the groove depth (i.e., groove volume per unit area) decreases over time, the state of hydrodynamic contact between the polishing pad and the substrate to be polishing decreases. Hence the CMP process performance as characterized by the removal rate and uniformity continually changes along with the continual decay in groove depth.

One approach to improving CMP process uniformity is disclosed in United States Patent Application Publication No. 2007/0238297 to Chandrasekaran et al. Chandrasekaran et al. disclose processing pads for mechanical and/or chemical-mechanical planarization or polishing of substrates in the fabrication of microelectronic devices, methods for making the pads, and methods, apparatus, and systems that utilize and incorporate the processing pads. In particular, the processing pads include grooves or other openings in the abrading surface containing a solid or partially solid fill material that can be selectively removed as desired to maintain the fill at an about constant or set distance from the abrading surface of the pad and an about constant depth of the pad openings for multiple processing and conditioning applications over the life of the pad.

Notwithstanding, there is a continuing need for improved CMP polishing pads and CMP polishing methods that promote more uniform and consistent substrate processing.

The present invention provides a method of polishing a substrate in which a consistent polishing pad thickness and/or groove depth can be maintained over multiple polishing cycles. By maintaining a consistent polishing pad thickness and/or groove depth over multiple polishing cycles, variations typically observed during the life of a conventional polishing pad with the decay in polishing pad thickness and/or groove depth can be alleviated. For example, with conventional chemical mechanical polishing pads having grooves at the polishing surface, groove volume and depth are both reduced as the polishing pad wears. Accordingly, polishing practitioners must vary other process conditions in the course of polishing to maintain the desired hydrodynamic state. This invention provides a method to decrease the extent of groove volume and depth reduction during polishing over the useful life of the polishing pad. For example, a shape memory chemical mechanical polishing pad of the present invention with a thermally treated (pre-compressed) polishing layer made of a temperature-sensitive shape memory material can be processed to maintain a consistent groove volume and depth by preferentially heating a region close to the polishing surface to counteract the loss in groove volume and depth due to polishing and conditioning. Selective surface heating of the polishing pad transitions the pad material in the heated region from a densified state to a recovered state, thereby adding to the groove volume and depth. Hence under similar conditions, the rate of groove volume and depth reduction during polishing operations can be minimized or eliminated using a shape memory chemical mechanical polishing pad with shape recovery.

In one aspect of the present invention, there is provided a method of polishing a substrate, comprising: providing a substrate selected from at least one of a magnetic substrate, an optical substrate and a semiconductor substrate; providing a shape memory chemical mechanical polishing pad having a pad thickness, PT; wherein the polishing pad comprises a polishing layer in a densified state, wherein the polishing layer comprises a shape memory matrix material having an original shape and a programmed shape; wherein the polishing layer exhibits an original thickness, OT, when the shape memory matrix material is in its original shape; wherein the polishing layer exhibits a densified thickness, DT, in the densified state when the shape memory matrix material is set in the programmed shape; wherein the DT is ≦80% of the OT; creating dynamic contact between a polishing surface of the polishing layer and the substrate to polish a surface of the substrate; monitoring at least one polishing pad property selected from a polishing pad thickness and at least one groove depth; and, exposing at least a portion of the polishing layer proximate the polishing surface to an activating stimulus; wherein the portion of the polishing layer proximate the polishing surface exposed to the activating stimulus transitions from the densified state to a recovered state.

In another aspect of the present invention, there is provided a method of polishing a substrate, comprising: providing a substrate selected from at least one of a magnetic substrate, an optical substrate and a semiconductor substrate; providing a shape memory chemical mechanical polishing pad having a pad thickness, PT; wherein the polishing pad comprises a polishing layer in a densified state, wherein the polishing layer comprises a shape memory matrix material having an original shape and a programmed shape; wherein the polishing layer exhibits an original thickness, OT, when the shape memory matrix material is in its original shape; wherein the polishing layer exhibits a densified thickness, DT, in the densified state when the shape memory matrix material is set in the programmed shape; wherein the DT is ≦80% of the OT; providing a controller; providing a measuring device capable of monitoring at least one polishing pad property selected from a polishing pad thickness and at least one groove depth; providing a source capable of creating an activating stimulus; creating dynamic contact between a polishing surface of the polishing layer and the substrate to polish a surface of the substrate; monitoring the at least one polishing pad property; and, exposing at least a portion of the polishing layer proximate the polishing surface to the activating stimulus; wherein the at least one polishing pad property for at least a portion of the polishing pad is decreased following the dynamic contact with the substrate; wherein the measuring device and the source communicate with the controller; wherein the measuring device inputs information to the controller regarding the at least one polishing pad property; and wherein the controller controls the source based on the information input from the measuring device, facilitating a selective exposure of the at least a portion of the polishing pad to the activating stimulus, such that the at least one polishing pad property is increased.

DETAILED DESCRIPTION

Figure 1:
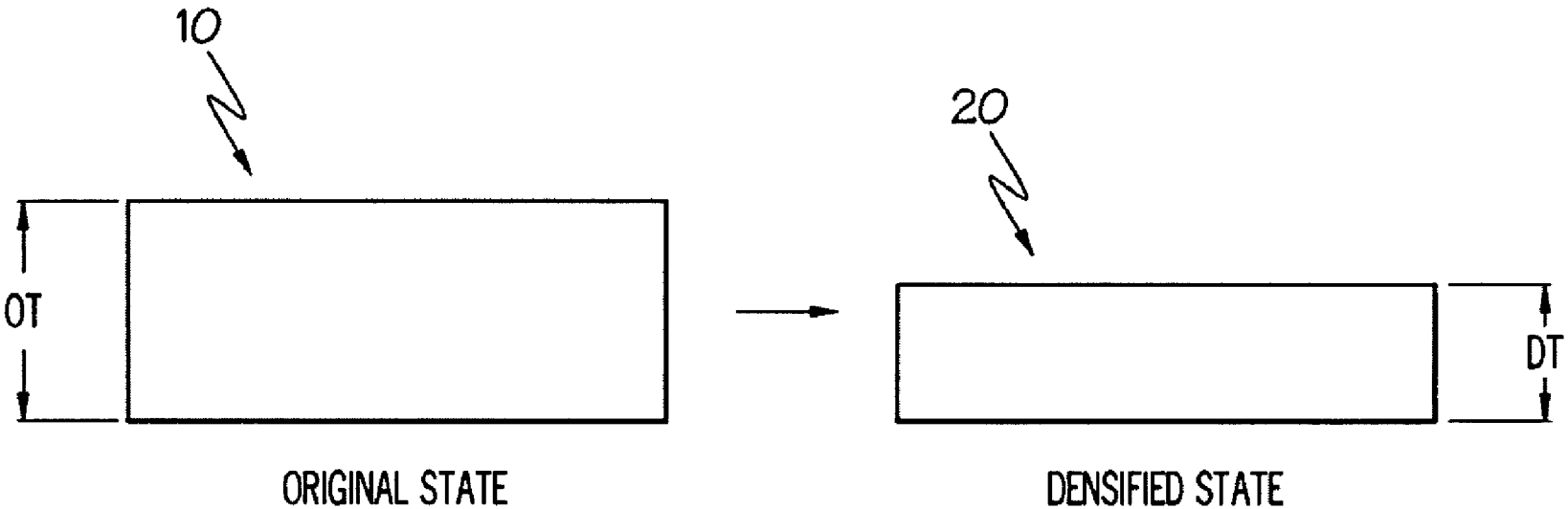
FIG. 1 is a comparative depiction of an elevation view of a polishing layer of a chemical mechanical polishing pad in an original state and a densified state.

The term "fibrillar morphology" as used herein and in the appended claims refers to a morphology of a phase in which the phase domains have a three dimensional shape with one dimension much larger than the other two dimensions.

The term "initial thickness" as used herein and in the appended claims in reference to a chemical mechanical polishing pad means the average actual thickness of the polishing pad immediately prior to the first dynamic interaction between the polishing pad and the first substrate to be polished.

The term "initial groove depth" as used herein and in the appended claims in reference to a chemical mechanical polishing pad means the average actual groove depth of the polishing pad immediately prior to the first dynamic interaction between the polishing pad and the first substrate to be polished.

The term "ex situ" as used herein and in the appended claims in reference to CMP processing describes actions (e.g., monitoring, measuring) performed during intermittent breaks in the CMP process when polishing is paused.

The term "in situ" as used herein and in the appended claims in reference to CMP processing describes actions (e.g., monitoring, measuring) performed while the CMP process is underway when polishing is taking place.

The term "polishing medium" as used herein and in the appended claims encompasses particle-containing polishing solutions and non-particle-containing solutions, such as abrasive-free and reactive-liquid polishing solutions.

The term "substantial relaxation" as used herein and in the appended claims means a sufficient relaxation in the shape memory matrix material in the polishing layer to cause a $\geqq$2% increase in the polishing layer's average thickness measured using a granite base comparator (e.g., a Chicago Dial Indicator Cat#6066-10).

The term "substantially circular cross section" as used herein and in the appended claims in reference to the polishing surface means that the radius, r, of the cross section from the central axis to the outer periphery of the polishing surface varies by $\leqq$20% for the cross section. (See FIG. 4).

The glass transition temperature ("Tg") for a shape memory matrix material of the present invention is measured by differential scanning calorimetry (DSC) taking the midpoint in the heat flow versus temperature transition as the $T_g$ value.

The term "original state" as used herein and in the appended claims in reference to a polishing layer of a shape memory chemical mechanical polishing pad of the present invention means the as made state before subjecting it to an external force to "lock-in" a reversible shape deformation to set the polishing layer in a densified state.

The term "microtexture" used herein and in the appended claims in reference to the polishing surface refers to the intrinsic microscopic bulk texture of the polishing surface after manufacture. Some of the factors which influence the static morphology or microscopic bulk texture of the polishing surface are the nature and texture including waves, holes, creases, ridges, slits, depressions, protrusions and gaps, and the size, shape and distribution, frequency or spacing of individual features or artifacts. The microtexture is typically largely random and is the result of factors intrinsic to the manufacturing process of the polishing layer.

The term "macrotexture" as used herein and in the appended claims in reference to the polishing surface refers to larger size textured artifacts that may be imposed by embossing, skiving, perforating and/or machining of the polishing surface.

The term "circumference fraction grooved" or "CF" as used herein and in the appended claims is defined by the following formula:

$$CF = \left\{ \frac{\text{(Portion of circumference at a given radius, } R\text{, that lies across any groove)}}{\text{(Full circumference at the given radius, } R\text{)}} \right\}$$

Note that if CF is constant as a function of radius for the polishing surface of a given shape memory chemical mechanical polishing pad, then the fractional portion of the polishing surface that is grooved (or ungrooved) at a given radius will also be constant as a function of radius.

The term "shape memory matrix material" as used herein and in the appended claims refers to materials that have the ability to exhibit a shape memory effect. That is, any materials or combination of materials that exhibit the following properties: (1) are capable of being deformed in at least one spatial dimension when exposed to an external force, (2) are capable of locking-in and maintaining a degree of the deformation in at least one spatial dimension after removal of the external force, and (3) are capable of exhibiting a recovery in at least one spatial dimension when subjected to an activating stimulus. Shape memory matrix materials are a class of smart materials that are designed and manufactured to react in a predetermined way according to changes in their environment. Shape memory matrix materials can be deformed from an original shape and fixed into a temporary (programmed) shape and upon exposure to an activating stimulus react to recover to a recovered shape that approximates the original shape.

The shape memory effect involves the programming of a "programmed shape" in a shape memory matrix material and subsequently causing the shape memory matrix material to recover to a "recovered shape" (which approximates the original shape) upon exposure of the shape memory matrix material to an activating stimulus. A shape memory matrix material is processed into the original shape by conventional methods. Subsequently it is deformed by exposure to an external force and a desired programmed shape is fixed. This later process is referred to herein as programming.

The "storage modulus" for a shape memory matrix material of the present invention is a measure of the stored elastic energy in the shape memory matrix material. The storage modulus represents a ratio of the stress in phase (with the strain) to the applied strain and is measured using a TA Q800 Dynamic Mechanical Analyzer using a single-cantilever clamp setup and a "multi-frequency-strain" testing mode of the instrument.

In some embodiments of the present invention, there is provided a method of polishing a substrate, comprising: providing a substrate selected from at least one of a magnetic substrate, an optical substrate and a semiconductor substrate; providing a shape memory chemical mechanical polishing pad having a pad thickness, PT; wherein the polishing pad comprises a polishing layer in a densified state, wherein the polishing layer comprises a shape memory matrix material having an original shape and a programmed shape; wherein the polishing layer exhibits an original thickness, OT, when the shape memory matrix material is in its original shape; wherein the polishing layer exhibits a densified thickness, DT, in the densified state when the shape memory matrix material is set in the programmed shape; wherein the DT is $\leqq$80% of the OT; creating dynamic contact between a polishing surface of the polishing layer and the substrate to polish a surface of the substrate; monitoring at least one polishing pad property selected from a polishing pad thickness and at least one groove depth; and, exposing at least a portion of the polishing layer proximate the polishing surface to an activating stimulus; wherein the portion of the polishing layer proximate the polishing surface exposed to the activating stimulus transitions from the densified state to a recovered state. In some aspects of these embodiments, the monitoring of the at least one polishing pad property is selected from continuous monitoring, periodic monitoring and intermittent monitoring. In some aspects of these embodiments, the monitoring is continuous monitoring. In some aspects of these embodiments, the monitoring is periodic monitoring. In some aspects of these embodiments, the monitoring is intermittent monitoring. In some aspects of these embodiments, the monitoring is performed in situ. In some aspects of these embodiments, the monitoring is performed ex situ.

In some embodiments of the present invention, the monitoring of at least one polishing pad property includes measuring the at least one polishing pad property. In some aspects of these embodiments, the at least one polishing pad property is measured at a plurality of locations on the polishing pad. In some aspects of these embodiments, the measurement of the polishing pad property at a plurality of locations is used to determine the uniformity across the polishing surface.

In some embodiments of the present invention, the monitoring of at least one polishing pad property is performed using an ultrasonic probe assembly. In some aspects of these embodiments, the ultrasonic probe assembly includes an ultrasonic source and an ultrasonic detector. The ultrasonic probe assembly transmits ultrasonic signals onto the polishing surface of the polishing pad. Some of the transmitted ultrasonic signals are reflected from the polishing surface and are detected by the ultrasonic detector. In some aspects of these embodiments, the reflected ultrasonic signals are analyzed in real time to provide real time, in situ, monitoring of the polishing pad. For example, polishing pad contour maps and profiles can be provided by correlating the reflected ultrasonic signals with polishing pad position data (i.e., location where the measurement was taken). In addition, real-time, in situ, polishing pad properties (e.g., pad thickness and/or groove depth) can be determined from the reflected ultrasonic signals.

In some embodiments of the present invention, the method of polishing a substrate further comprises: conditioning the polishing surface of the polishing layer. In some aspects of these embodiments, the conditioning is abrasive conditioning. In some aspects of these embodiments, the conditioning is selected from diamond disk conditioning and high pressure water jet conditioning. In some aspects of these embodiments, conditioning helps to minimize any changes to the pad thickness and/or groove depth during polishing for the useful life of the polishing pad. In some aspects of these embodiments, the thickness (and/or groove depth) of the polishing pad is reduced as a result of the polishing and conditioning processes. The thickness (and/or groove depth) loss from the polishing and conditioning processes is counteracted in the methods of the present invention through the transitioning of a portion of the polishing layer from the densified state to a recovered state. In some aspects of these embodiments, the conditioning of the polishing surface occurs (a) during the exposure of at least a portion of the polishing layer to the activating stimulus; (b) after the exposure of at least a portion of the polishing layer to the activating stimulus; (c) simultaneously with the exposure of at least a portion of the polishing layer to the activating stimulus; or, (d) a combination of at least two of (a)-(c). In some aspects of these embodiments, the conditioning of the polishing surface occurs after the exposure of at least a portion of the polishing layer to the activating stimulus. In some aspects of these embodiments, the decrease in polishing pad thickness (and/or groove depth) is more than recovered following exposure of the polishing layer to an activating stimulus; the polishing pad is then subjected to abrasive conditioning such that the increased thickness (and/or groove depth) of the polishing pad is abraded away such that the thickness (and/or groove depth) of the polishing pad following the activating stimulus exposure and the subsequent abrasive conditioning is equal to the initial thickness (and/or initial groove depth) ±5%; ±2%; ±1% for the useful life of the polishing pad (e.g., following polishing >1,000 wafers).

In some embodiments of the present invention, the method of polishing a substrate further comprises: providing a source capable of creating the activating stimulus. In some aspects of these embodiments, the polishing pad is exposed to the activating stimulus in situ, ex situ or a combination thereof. In some aspects of these embodiments, the activating stimulus is selected from exposure to heat, light, a magnetic field, an electric field, water, pH, and combinations thereof. In some aspects of these embodiments, the activating stimulus is exposure to heat. There are a variety of known conventional devices that are capable of operating as a source of heat as an activating stimulus (e.g., electronically controlled infrared based heating device, Model #GPIR, available from Micropyretics Heaters International Inc, OH). In some aspects of these embodiments, the activating stimulus is exposure to heat and the source heats the polishing medium, which subsequently heats the polishing layer proximate the polishing surface causing a portion of the polishing layer to transition to a recovered state. In some aspects of these embodiments, the activating stimulus is exposure to heat and the source directly heats at least a portion of the polishing layer proximate the polishing surface causing a portion of the polishing layer to transition to a recovered state.

In some embodiments of the present invention, the method of polishing a substrate further comprises: providing a controller; providing a measuring device capable of monitoring the at least one polishing pad property; providing a source capable of creating the activating stimulus; wherein the at least one polishing pad property for at least a portion of the polishing pad is subject to modifying forces during CMP processing (e.g., abrasive contact with the substrate, abrasive conditioning); wherein the measuring device and the source communicate with the controller; wherein the measuring device inputs information to the controller regarding the at least one polishing pad property; and wherein the controller controls the source based on the information input from the measuring device, facilitating the selective exposure of at least a portion of the polishing layer to the activating stimulus, such that the at least one polishing pad property is increased or maintained consistent. In some aspects of these embodiments, the controller is a control system. In some aspects of these embodiments, the control system contains a first closed-loop feedback process for monitoring a relative change in polishing pad thickness (and/or groove depth) and reversing that change by adjusting the source causing at least a portion of the polishing layer proximate the polishing surface to transition to a recovered state. In some aspects of these embodiments, the first closed-loop feedback process comprises: i) applying a control signal to the controller; and ii) processing output signals from the controller to adjust the source. In some aspects of these embodiments, the source is adjusted to generate an activating stimulus and to selectively expose at least a portion of the polishing layer proximate the polishing surface to the activating stimulus. In some aspects of these embodiments the source is adjusted to control the magnitude of the activating stimulus and the extent of exposure in time, volume and area of the polishing layer to the activating stimulus.

In some embodiments of the present invention, there is provided a method of polishing a substrate, comprising: providing a substrate selected from at least one of a magnetic substrate, an optical substrate and a semiconductor substrate; providing a shape memory chemical mechanical polishing pad having a pad thickness, PT; wherein the polishing pad comprises a polishing layer in a densified state, wherein the polishing layer comprises a shape memory matrix material having an original shape and a programmed shape; wherein the polishing layer exhibits an original thickness, OT, when the shape memory matrix material is in its original shape; wherein the polishing layer exhibits a densified thickness, DT, in the densified state when the shape memory matrix material is set in the programmed shape; wherein the DT is ≦80% of the OT; providing a controller; providing a measuring device capable of monitoring at least one polishing pad property selected from a polishing pad thickness and at least one groove depth; providing a source capable of creating an activating stimulus; creating dynamic contact between a polishing surface of the polishing layer and the substrate to polish a surface of the substrate; monitoring the at least one polishing pad property; exposing at least a portion of the polishing layer proximate the polishing surface to the activating stimulus; and, abrasive conditioning of the polishing surface; wherein the at least one polishing pad property for at least a portion of the polishing pad is reduced as a result of the polishing and abrasive conditioning processes; wherein the measuring device and the source communicate with the controller; wherein the measuring device inputs information to the controller regarding the at least one polishing pad property; and wherein the controller controls the source based on the information input from the measuring device, facilitating a selective exposure of the at least a portion of the polishing pad to the activating stimulus, such that the at least one polishing pad property is increased. In some aspects of these embodiments, abrasive conditioning follows exposure of at least a portion of the polishing layer to an activating stimulus. In some aspects of these embodiments, abrasive conditioning precedes exposure of at least a portion of the polishing layer to an activating stimulus. In some aspects of these embodiments, the polishing layer is simultaneously subjected to both abrasive conditioning and exposure to an activating stimulus. In some aspects of these embodiments, the abrasive conditioning is selected from diamond disk conditioning and high pressure water jet conditioning. In some aspects of these embodiments, the controller is a control system. In some aspects of these embodiments, the control system contains a first closed-loop feedback process as described hereinabove. In some aspects of these embodiments, the control system further contains a second closed-loop feedback process for monitoring a relative change in polishing pad thickness (and/or groove depth) and adjusting the abrasive pad conditioning. In some aspects of these embodiments, the second closed-loop feedback process comprises: i) applying a control signal to the controller; and ii) processing output signals from the controller to adjust the abrasive pad conditioning. In some aspects of these embodiments, the control system alternates between the first closed-loop feedback process and the second closed-loop feedback process. In some aspects of these embodiments, the control system operates with the first closed-loop feedback process and the second closed-loop feedback process simultaneously.

In some embodiments of the present invention, the methods further comprise interfacing the shape memory chemical mechanical polishing pad with a platen of a polishing machine. In some aspects of these embodiments, the method further comprises interfacing the shape memory chemical mechanical polishing pad with a platen of a polishing machine using at least one of a pressure sensitive adhesive and vacuum. In some aspects of these embodiments, the polishing pad thickness and/or groove depth is monitored and controlled by: a) providing a non-contacting measurement system adapted to determine a relative distance from a sensor to an object; b) disposing the sensor adjacent to the polishing surface of the polishing pad at a set distance from the platen to which the polishing pad is interfaced; c) measuring the distance from the sensor to the polishing surface to determine an initial value of at least one polishing pad property selected from a pad thickness (i.e., an initial pad thickness) and at least one groove depth (i.e., an initial groove depth); d) polishing at least one substrate with the polishing surface; e) re-measuring the distance from the sensor to the polishing surface to determine a change in the at least one polishing pad property; f) (1) controlling a source of an activating stimulus to selectively expose at least a portion of the polishing layer proximate the polishing surface to the activating stimulus based on a comparison of the measurements determining polishing pad condition by comparing the measurement (c) to the re-measurement in (e); and g) repeating (d) through (f) for multiple polishing operations. In some aspects of these embodiments, f) further comprises (2) controlling an abrasive conditioning device to selectively condition the polishing surface. In some aspects of these embodiments, the closed-loop feedback process facilitates the continuous monitoring and control of the at least one polishing pad property during at least one polishing operation. In some aspects of these embodiments, the measurement system comprises a radiation source that provides a source of radiation. In some aspects of these embodiments, the source of radiation creates at least one of ultrasound energy and electromagnetic energy. In some aspects of these embodiments, the electromagnetic energy is selected from the group of visible light, ultraviolet light, and infra-red light.

Figure 21:
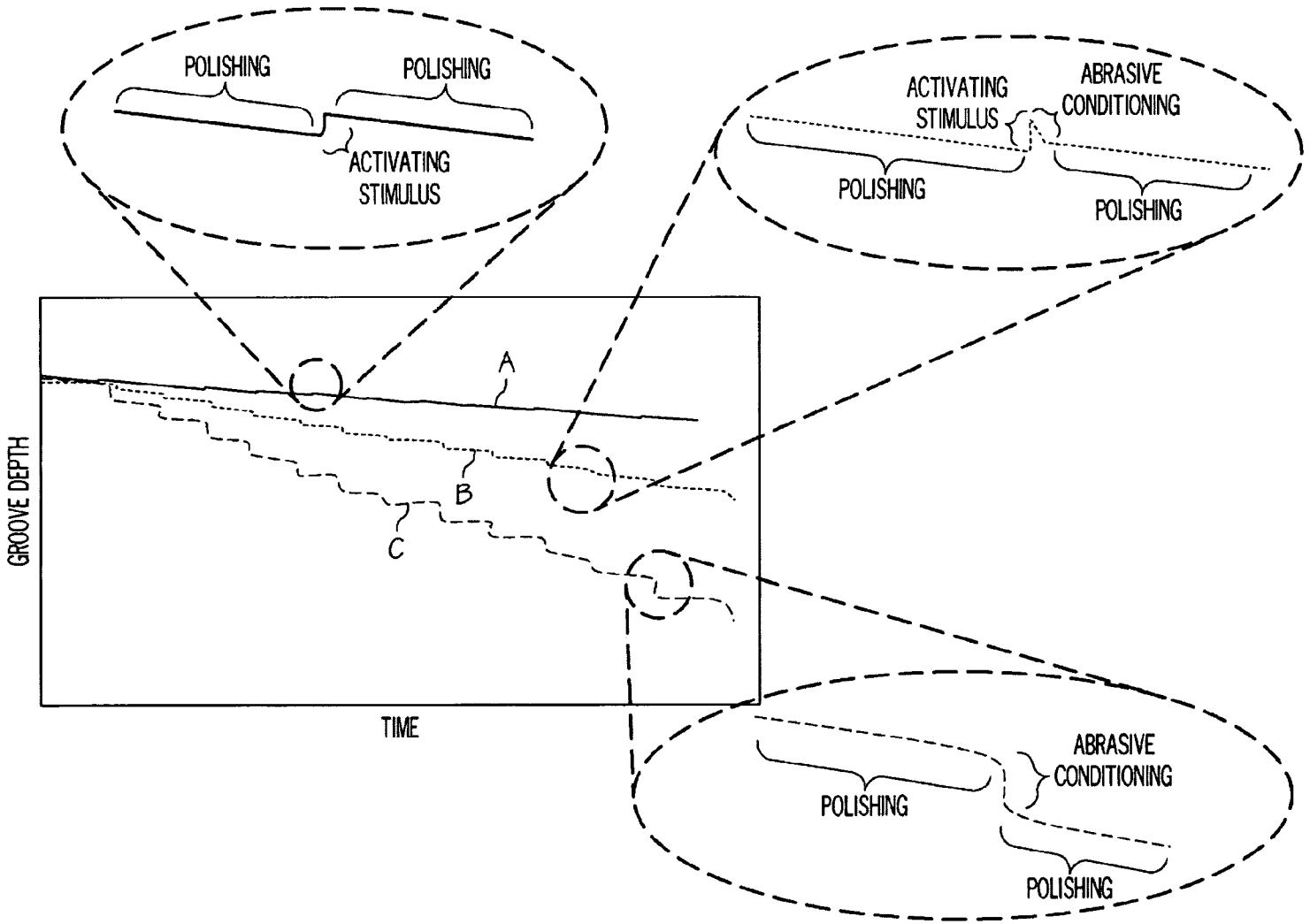
FIG. 21 is an illustrative, graphical representation of one perceived benefit of the present invention (i.e., a more consistent polishing pad groove depth over time).

FIG. 21 provides an illustrative, graphical representation of one perceived benefit of some embodiments of the present invention (i.e., a more consistent polishing pad groove depth over time, which helps to achieve more consistent CMP process performance over the useful life of the polishing pad). Specifically, the curves depicted in FIG. 21 show how the groove depth of a polishing pad might decay with time for different CMP processes. Curve A in FIG. 21 is a representation of how the groove depth of a shape memory chemical mechanical polishing pad might decay with time for a CMP process of the present invention using shape memory recovery of the polishing surface without abrasive conditioning, wherein the groove depth is decayed over time with polishing and is periodically recovered through exposure of the polishing surface to an activating stimulus. Curve B in FIG. 21 is a representation of how the groove depth of a shape memory chemical mechanical polishing pad might decay with time for a CMP process of the present invention using shape memory recovery of the polishing surface in combination with abrasive conditioning (e.g., diamond disc conditioning), wherein the groove depth is decayed over time with polishing, is periodically recovered through exposure of the polishing surface to an activating stimulus and is periodically decayed through abrasive conditioning. Curve C in FIG. 21 is a representation of how the groove depth of a conventional polishing pad having a polishing layer filed with microballons might decay with time for a conventional CMP process using abrasive conditioning (e.g., diamond disc conditioning), wherein the groove depth is decayed over time with polishing and is periodically decayed through abrasive conditioning. In such conventional CMP processes, it is common practice to periodically regenerate the polishing surface by abrading away a layer of polishing pad material comparable in thickness to the mean diameter of the microballons (e.g., ~50 microns).

In some embodiments of the present invention, the method of polishing a substrate further comprises: providing a polishing medium at an interface between the polishing surface and the surface of the substrate. In some aspects of these embodiments, the polishing medium is at least one of a particle-containing polishing solution and a non-particle-containing solution (e.g., an abrasive-free and reactive-liquid polishing solution). In some aspects of these embodiments, the polishing medium is a particle-containing aqueous slurry. In some aspects of these embodiments, the polishing medium is a reactive liquid polishing solution that contains less than 3.0 wt % abrasive. In some aspects of these embodiments, the polishing medium is a reactive liquid polishing solution that contains less than 0.1 wt % abrasive. In some aspects of these embodiments, the polishing medium is abrasive free.

In some embodiments of the present invention, the shape memory chemical mechanical polishing pad used comprises a polishing layer comprising a shape memory matrix material comprising at least one polymer. In some aspects of these embodiments, the shape memory matrix material comprises at least one polymer selected from segmented block copolymers comprising at least one hard segment and at least one soft segment. In some aspects of these embodiments, the shape memory matrix material comprises at least one polymer selected from polyester based thermoplastic polyurethanes; polyether based polyurethanes; polyethylene oxide; poly (ether ester)block copolymers; polyamides; poly(amide esters); poly(ether amide) copolymers; polyvinyl alcohol; polyvinyl pyrrolidon; polyvinyl pyridine; polyacrylic acid; polymethacrylic acid; polyaspartic acid; maleic anhydride methylvinyl ether copolymers; polyvinyl methyl ether copolymers of polyacrylic acid and polyacrylic esters; styrenic polymers; epoxide based polymers; polycyanurates; and combinations thereof (e.g., copolymers and blends). In some aspects of these embodiments, the shape memory matrix material comprises a segmented block copolymer comprising at least one hard segment and at least one soft segment, where either the soft segment, the hard segment, or both contain functional groups or receptor sites that are "stimuli responsive", i.e. that enable a desired amount of shape recovery when exposed to an activating stimulus. In some aspects of these embodiments, the activating stimulus is selected from exposure to heat, light, a magnetic field, an electric field, water, pH, and combinations thereof. In some aspects of these embodiments, the activating stimulus is exposure to heat.

In some embodiments of the present invention, the shape memory chemical mechanical polishing pad used comprises a polishing layer comprising a shape memory matrix material comprising a segmented block copolymer. In some aspects of these embodiments, the segmented block copolymer is selected from polyurethane elastomers, polyether elastomers, poly(ether amide) elastomers, polyether polyester elastomers, polyamide-based elastomers, thermoplastic polyurethanes, poly(ether-amide) block copolymers, thermoplastic rubbers (e.g., un-crosslinked polyolefins), styrene-butadiene copolymers, silicon rubbers, synthetic rubbers (e.g., nitrile rubber and butyl rubber), ethylene-vinyl acetate copolymers, styrene-isoprene copolymers, styrene-ethylene-butylene copolymers and combinations thereof. In some aspects of these embodiments, the shape memory matrix material further comprises a non-elastomeric polymer. In some aspects of these embodiments, the non-elastomeric polymer is selected from polyethylene oxide, copolymers of polylactic acid and combinations thereof.

In some embodiments of the present invention, the shape memory chemical mechanical polishing pad used comprises a polishing layer comprising a shape memory matrix material comprising a polyurethane. In some aspects of these embodiments, the polyurethane is selected from polyester-based aromatic polyurethanes; polyester-based aliphatic polyurethanes; polyether-based aliphatic and aromatic polyurethanes; and combinations thereof.

In some embodiments of the present invention, the shape memory matrix material comprises a reaction product of a mixture comprising a polyether-based, toluene diisocyanate terminated liquid urethane prepolymer; and a 4,4'-methylene-bis(2-chloroaniline).

In some embodiments of the present invention, the shape memory chemical mechanical polishing pad used comprises a polishing layer comprising a shape memory matrix material comprising a reaction product of a mixture comprising glycerol propoxylate; polycarbodiimide-modified diphenylmethane diisocyanate; and at least one of polytetrahydrofuran and polycaprolactone. In some aspects of these embodiments, the shape memory matrix material comprises a reaction product of a mixture comprising glycerol propoxylate; polycarbodiimide-modified diphenylmethane diisocyanate; and polytetrahydrofuran. In some aspects of these embodiments, the shape memory matrix material comprises a reaction product of a mixture comprising glycerol propoxylate; polycarbodiimide-modified diphenylmethane diisocyanate; and polycaprolactone.

In some embodiments of the present invention, the shape memory chemical mechanical polishing pad used comprises a polishing layer comprising a shape memory matrix material, as described above, and a plurality of microelements. In some aspects of these embodiments, the plurality of microelements is uniformly dispersed within the polishing layer. In some aspects of these embodiments, the plurality of microelements are selected from entrapped gas bubbles, hollow core polymeric materials, liquid filled hollow core polymeric materials, water soluble materials and an insoluble phase material (e.g., mineral oil). In some aspects of these embodiments, the plurality of microelements comprises hollow core polymeric materials uniformly distributed throughout the polishing layer.

In some embodiments of the present invention, the shape memory chemical mechanical polishing pad used, comprises a polishing layer in a densified state; wherein the polishing layer comprises a shape memory matrix material transformable between an original shape (i.e., an as made shape) and a programmed shape; wherein the polishing layer exhibits an original thickness, OT, when the shape memory matrix material is in the original shape; wherein the polishing layer exhibits a densified thickness, DT, in the densified state when the shape memory matrix material is in the programmed shape; wherein the DT is ≦80% of the OT; and, wherein the polishing layer has a polishing surface adapted for polishing the substrate. In some aspects of these embodiments, the densified thickness, DT, is ≦70% of the original thickness, OT. In some aspects of these embodiments, the densified thickness, DT, is between 70 and 40% of the original thickness, OT. In some aspects of these embodiments, the substrate is a semiconductor substrate. In some aspects of these embodiments, the substrate is a semiconductor wafer.

In some embodiments of the present invention, the shape memory chemical mechanical polishing pad used comprises a polishing layer comprising a shape memory matrix material selected to exhibit a $T_g$ of ≧45° C. and ≦80° C.; wherein the activating stimulus is exposure to heat. In some aspects of these embodiments, the shape memory matrix material is selected to exhibit a $T_g$ of ≧45° C. and ≦75° C.; ≧50° C. and ≦75° C.; ≧55° C. and ≦75° C.; ≧55° C. and ≦70° C.; or ≧55° C. and ≦65° C.

In some embodiments of the present invention, the shape memory chemical mechanical polishing pad used, comprises: a polishing layer in a densified state; wherein the polishing layer comprises a shape memory matrix material transformable between an original shape and a programmed shape; wherein the polishing layer exhibits an original thickness, OT, when the shape memory matrix material is in the original shape; wherein the polishing layer exhibits a densified thickness, DT, in the densified state when the shape memory matrix material is in the programmed shape; wherein the DT is <80% of the OT; wherein the shape memory matrix material exhibits a ≧70% reduction in storage modulus as the temperature of the shape memory matrix material is raised from $(T_g-20)$° C. to $(T_g+20)$° C.; wherein the activating stimulus is exposure to heat; and, wherein the polishing layer has a polishing surface adapted for polishing the substrate. In some aspects of these embodiments, the shape memory matrix material exhibits a ≧75% reduction; ≧80% reduction; ≧85% reduction; or ≧90% reduction in storage modulus as the temperature of the shape memory matrix material is raised from $(T_g-20)$° C. to $(T_g+20)$° C.; $(T_g-10)$° C. to $(T_g+10)$° C.; or $(T_g-5)$° C. to $(T_g+5)$° C. In some aspects of these embodiments, the reduction in storage modulus has a magnitude of ≧800 MPa; ≧900 MPa; ≧1,000 MPa; ≧800 MPa and ≦10,000 MPa; ≧800 MPa and ≦5,000 MPa; or ≧800 MPa and ≦2,500 MPa. In some aspects of these embodiments, the shape memory matrix material exhibits a ≧90% reduction in storage modulus as the temperature of the shape memory matrix material is raised from $(T_g-10)$° C. to $(T_g+10)$° C., wherein the reduction in storage modulus has a magnitude of ≧800 MPa.

In some embodiments of the present invention, the shape memory chemical mechanical polishing pad used has a central axis and is adapted for rotation about the central axis. (See FIG. 4). In some aspects of these embodiments, the polishing layer 210 of the shape memory chemical mechanical polishing pad is in a plane substantially perpendicular to the central axis 212. In some aspects of these embodiments, the polishing layer 210 is adapted for rotation in a plane that is at an angle, γ, of 80 to 100° to the central axis 212. In some aspects of these embodiments, the polishing layer 210 is adapted for rotation in a plane that is at an angle, y, of 85 to 95° to the central axis 212. In some aspects of these embodiments, the polishing layer 210 is adapted for rotation in a plane that is at an angle, γ, of 89 to 91° to the central axis 212. In some aspects of these embodiments, the polishing layer 210 has a polishing surface 214 that has a substantially circular cross section perpendicular to the central axis 212. In some aspects of these embodiments, the radius, r, of the cross section of the polishing surface 214 perpendicular to the central axis 212 varies by ≦20% for the cross section. In some aspects of these embodiments, the radius, r, of the cross section of the polishing surface 214 perpendicular to the central axis 212 varies by ≦10% for the cross section.

In some embodiments of the present invention, the shape memory chemical mechanical polishing pad used has a polishing surface exhibiting macrotexture. In some aspects of these embodiments, the macrotexture is designed to alleviate at least one of hydroplaning; to influence polishing medium flow; to modify the stiffness of the polishing layer; to reduce edge effects; and, to facilitate the transfer of polishing debris away from the area between the polishing surface and the substrate. In some aspects of these embodiments, the macrotexture comprises at least one groove. In some aspects of these embodiments, the at least one groove has an initial groove depth of ≧20 mils. In some aspects of these embodiments, the at least one groove has an initial depth of 20 to 100 mils. In some aspects of these embodiments, the at least one groove has an initial groove depth of 20 to 60 mils. In some aspects of these embodiments, the at least one groove has an initial groove depth of 20 to 50 mils.

In some embodiments of the present invention, the shape memory chemical mechanical polishing pad used comprises a polishing layer having a macrotexture comprising a groove pattern. In some aspects of these embodiments, the groove pattern comprises at least one groove. In some aspects of these embodiments, the groove pattern comprises a plurality of grooves. In some aspects of these embodiments, the at least one groove is selected from curved grooves, straight grooves and combinations thereof. In some aspects of these embodiments, the groove pattern is selected from a groove design including, for example, concentric grooves (which may be circular or spiral), curved grooves, cross-hatch grooves (e.g., arranged as an X-Y grid across the pad surface), other regular designs (e.g., hexagons, triangles), tire-tread type patterns, irregular designs (e.g., fractal patterns), and combinations thereof. In some aspects of these embodiments, the groove pattern is selected from random, concentric, spiral, cross-hatched, X-Y grid, hexagonal, triangular, fractal and combinations thereof. In some aspects of these embodiments, the groove profile is selected from rectangular with straight sidewalls or the groove cross-section may be "V"-shaped, "U"-shaped, triangular, saw-tooth, and combinations thereof. In some aspects of these embodiments, the groove pattern is a groove design that changes across the polishing surface. In some aspects of these embodiments, the groove design is engineered for a specific application. In some aspects of these embodiments, the groove dimensions in a specific design may be varied across the pad surface to produce regions of different groove densities.

In some embodiments of the present invention, the shape memory chemical mechanical polishing pad has a macrotexture comprising a groove pattern that comprises at least one groove, wherein CF remains within 25%, preferably within 10%, more preferably within 5% of its average value as a function of a polishing pad radius, R, in an area extending from an outer radius, $R_O$, of a polishing surface a majority distance to an origin, O, at a center of the polishing surface. In some aspects of these embodiments, CF remains within 25%, preferably within 10%, more preferably within 5% of its average value as a function of a polishing pad radius, R, in an area extending from a base radius, $R_B$, to an outer radius, $R_O$. (See, e.g., FIG. 9).

In some embodiments of the present invention, the shape memory chemical mechanical polishing pad used has perforations through the pad, the introduction of conductive-lined grooves or the incorporation of a conductor, such as conductive fibers, conductive network, metal grid or metal wire, which can transform the shape memory chemical mechanical polishing pad into an eCMP ("electrochemical mechanical planarization") polishing pad.

In some embodiments of the present invention, the shape memory chemical mechanical polishing pad used comprises a polishing layer interfaced with a base layer. In some aspects of these embodiments, the polishing layer is attached to the base layer using an adhesive. In some aspects of these embodiments, the adhesive is selected from pressure sensitive adhesives, hot melt adhesives, contact adhesives and combinations thereof. In some aspects of these embodiments, the adhesive is a hot melt adhesive. In some aspects of these embodiments, the adhesive is a contact adhesive. In some aspects of these embodiments, the adhesive is a pressure sensitive adhesive.

In some embodiments of the present invention, the shape memory chemical mechanical polishing pad used comprises a polishing layer, a base layer and at least one additional layer interposed between the base layer and the polishing layer.

In some embodiments of the present invention, the shape memory chemical mechanical polishing pad used is adapted to be interfaced with a platen of a polishing machine. In some aspects of these embodiments, the shape memory chemical mechanical polishing pad is adapted to be affixed to the platen. In some aspects of these embodiments, the shape memory chemical mechanical polishing pad is adapted to be affixed to the platen using at least one of a pressure sensitive adhesive and vacuum.

In some embodiments of the present invention, the shape memory chemical mechanical polishing pad used can be produced by a process that comprises: providing a shape memory matrix material transformable between an original shape and a programmed shape; preparing a polishing layer in an original state exhibiting an original thickness, OT, comprising the shape memory matrix material in the original shape; heating at least a portion of the polishing layer to a temperature $\geqq(T_g+10)°$ C.; subjecting the polishing layer to an external force, wherein the external force is an axial force that axially compresses the polishing layer; setting the shape memory matrix material to the programmed shape to provide the polishing layer in a densified state, wherein the polishing layer exhibits a densified thickness, DT; cooling the polishing layer to a temperature $\leqq(T_g-10)°$ C. while maintaining the axial force to set the polishing layer in the densified state; and, removing the external force; wherein $T_g$ is the glass transition temperature for the shape memory matrix material; wherein the DT is ≦80% of the OT; and, wherein the polishing layer has a polishing surface adapted for polishing a substrate selected from at least one of a magnetic substrate, an optical substrate and a semiconductor substrate. In some aspects of these embodiments, the polishing layer is heated to a temperature $\geqq(T_g+10)°$ C., but below the decomposition temperature for the shape memory matrix material. In some aspects of these embodiments, the polishing layer is heated and compressed in the thickness direction to facilitate programming of the shape memory matrix material and to transition the polishing layer from the original state to the densified state. In some aspects of these embodiments, the substrate is a semiconductor substrate. In some aspects of these embodiments, the substrate is a semiconductor wafer.

In some embodiments of the present invention, the shape memory chemical mechanical polishing pad used can be produced by a process that comprises: providing a shape memory matrix material transformable between an original shape and a programmed shape; preparing a polishing layer in an original state exhibiting an original thickness, OT, comprising the shape memory matrix material in the original shape; subjecting the polishing layer to an external force; setting the shape memory matrix material to the programmed shape to provide the polishing layer in a densified state, wherein the polishing layer exhibits a densified thickness, DT; removing the external force; wherein the DT is ≦80% of the OT; wherein the shape memory matrix material exhibits a ≧70% reduction in storage modulus as the temperature of the shape memory matrix material is raised from $(T_g-20)°$ C. to $(T_g+20)°$ C.; and, wherein the polishing layer has a polishing surface adapted for polishing a substrate selected from at least one of a magnetic substrate, an optical substrate and a semiconductor substrate. In some aspects of these embodiments, the densified thickness, DT, is ≦70% of the original thickness, OT. In some aspects of these embodiments, the densified thickness, DT, is between 70 and 40% of the original thickness, OT. In some aspects of these embodiments, the shape memory matrix material exhibits a ≧75% reduction; ≧80% reduction; ≧85% reduction; or ≧90% reduction in storage modulus as the temperature of the shape memory matrix material is raised from ($T_g$−20)° C. to ($T_g$+20)° C.; ($T_g$−10)° C. to ($T_g$+10)° C.; or ($T_g$−5)° C. to ($T_g$+5)° C. In some aspects of these embodiments, the reduction in storage modulus has a magnitude of ≧800 MPa; ≧900 MPa; ≧1,000 MPa; ≧800 MPa and ≦10,000 MPa; ≧800 MPa and ≦5,000 MPa; or ≧800 MPa and ≦2,500 MPa. In some aspects of these embodiments, the shape memory matrix material exhibits a ≧90% reduction in storage modulus as the temperature of the shape memory matrix material is raised from ($T_g$−10)° C. to ($T_g$+10)° C., wherein the reduction in storage modulus has a magnitude of ≧800 MPa. In some aspects of these embodiments, the substrate is a semiconductor substrate. In some aspects of these embodiments, the substrate is a semiconductor wafer.

In some embodiments of the present invention, the shape memory chemical mechanical polishing pad used is produced by a process that comprises the application of an external force to the polishing layer to set the shape memory matrix material in the programmed shape. In some aspects of these embodiments, the external force is a nominal axial force that imposes a nominal pressure on the polishing layer of ≧150 psi. In some aspects of these embodiments, the nominal pressure imposed on the polishing layer is ≧300 psi. In some aspects of these embodiments, the nominal pressure imposed on the polishing layer is 150 to 10,000 psi. In some aspects of these embodiments, the nominal pressure imposed on the polishing layer is 300 to 5,000 psi. In some aspects of these embodiments, the nominal pressure imposed on the polishing layer is 300 to 2,500 psi.

In some embodiments of the present invention, the shape memory chemical mechanical polishing pad used is prepared using a shape memory matrix material in an original shape by any known means to provide the polishing layer in the original state exhibiting an original thickness, OT. In some aspects of these embodiments, the polishing layer is made by a process selected from casting, injection molding (including reaction injection molding), extruding, web-coating, photo-polymerizing, sintering, printing (including ink-jet printing and screen printing), spin-coating, weaving, skiving and combinations thereof. In some aspects of these embodiments, the polishing layer is prepared by a combination of casting and skiving.

In some embodiments of the present invention, the shape memory chemical mechanical polishing pad used is produced by a method comprising the conversion of the polishing layer from the original state having an original thickness, OT, to a densified state having an densified thickness, DT, by applying a force to compress the polishing layer at a temperature around or above the glass transition temperature, $T_g$, for the shape memory matrix material; cooling the polishing layer to a temperature below the $T_g$ to lock in the densified thickness, DT; and removing the force applied to compress the polishing layer.

In some embodiments of the present invention, the shape memory chemical mechanical polishing pads used have macrotexture incorporated into the polishing layer. In some aspects of these embodiments, the macrotexture is incorporated into the polishing layer when the polishing layer is in an original state. In some aspects of these embodiments, the macrotexture is incorporated into the polishing layer when the polishing layer is in a densified state. In some aspects of these embodiments, some of the macrotexture is incorporated into the polishing layer when the polishing layer is in an original state and some of the macrotexture is incorporated into the polishing layer when the polishing layer is in a densified state. In some aspects of these embodiments, the macrotexture is incorporated in the polishing layer using a cutting bit. In some aspects of these embodiments, it may be desirable to cool the cutting bit or the polishing layer or both to minimize the amount of any shape memory matrix material that transitions from a programmed shape to a recovered shape on account of the macrotexture incorporation process. In some aspects of these embodiments, the process of incorporating the macrotexture into the polishing layer comprises cooling the cutting bit, cooling a region of the polishing layer in proximity with the cutting bit or a combination thereof. In some aspects of these embodiments, the cooling can be achieved through various techniques, for example, blowing compressed air over the cutting bit to facilitate convection, blowing chilled air over the cutting bit, spraying the cutting bit with water or blowing cooled gases on the cutting bit. In some aspects of these embodiments, the cooling is achieved by blowing cooled, liquefied or cryogenic gas (e.g., argon, carbon dioxide, nitrogen) directly onto the cutting bit, a region of the polishing pad in proximity to the cutting bit, or a combination thereof. In some aspects of these embodiments, the cooled, liquefied or cryogenic gas is sprayed through a specialized nozzle or nozzles, wherein the gas rapidly expands, cools, and forms solid crystals or liquid to facilitate heat transfer. In some aspects of these embodiments, the use of such cooling techniques involve the creation of a flow of material (e.g., gas, liquid or crystals) and directing the flow to encounter the cutting bit, the region of the polishing layer in proximity with the cutting bit, or both. In some aspects of these embodiments, the flow of material directed at the polishing pad in the region in proximity with the cutting bit has the additional effect of aiding in the removal of chips formed in the macrotexture incorporation process. Removing these chips may be beneficial in that it reduces the potential for the chips reattaching to the polishing layer, for example, by melting, fusing or welding. To the extent that removing chips during the macrotexture incorporation process reduces the number of chips that reattach to the polishing layer, defects in subsequent polishing operations using the polishing layer may be avoided. In some aspects of these embodiments, the entire polishing layer is cryogenically cooled. In some aspects of these embodiments, the entire polishing layer and the machining fixture used to power the cutting bit is cryogenically cooled.

In the particular embodiments described herein in reference to the Figures, the activating stimulus is exposure to heat. Notwithstanding, given the teachings provided herein, one of ordinary skill in the art would know how to employ other activating stimuli such as, for example, exposure to light, a magnetic field, an electric field, and/or water.

In FIG. 1 there is provided a comparative depiction of an elevation view of a polishing layer of a shape memory chemical mechanical polishing pad. In particular, FIG. 1 provides a comparison of a polishing layer in an original state 10 with an original thickness, OT, to the same polishing layer in a densified state 20 with a densified thickness, DT.

Figure 2:
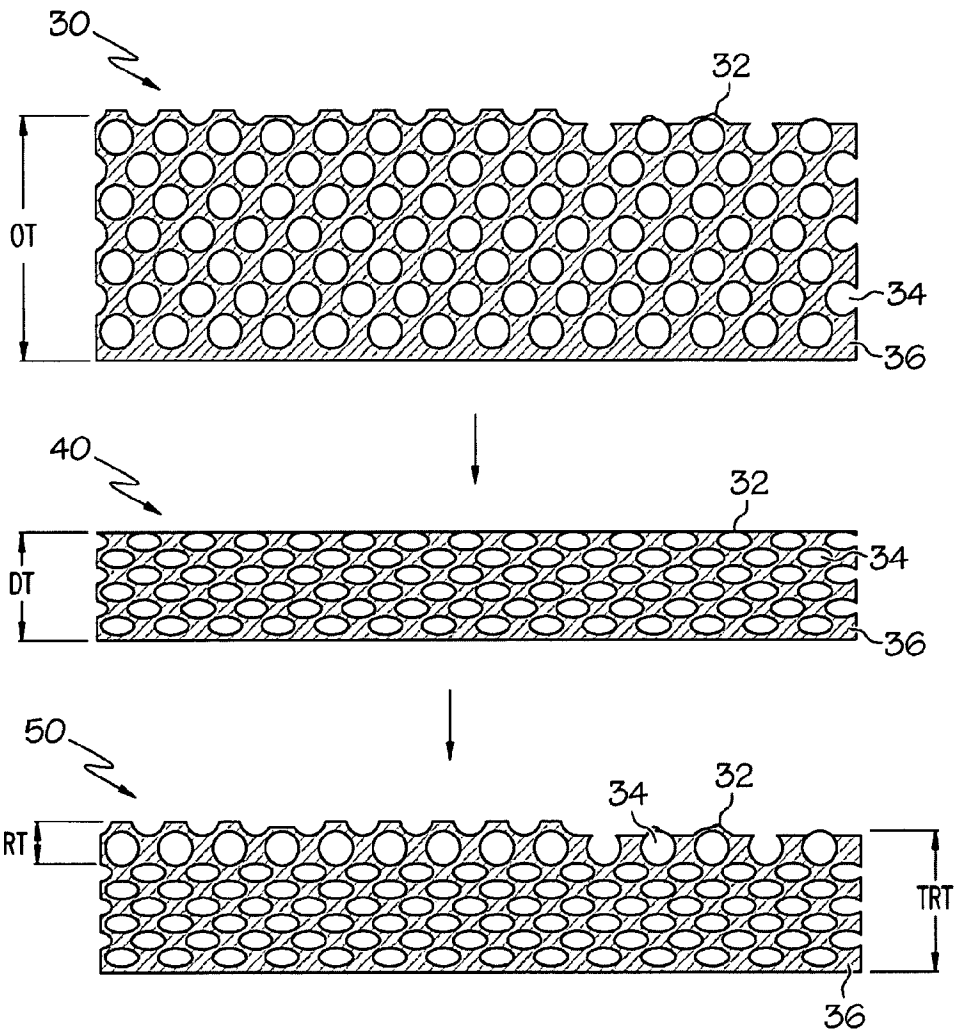
FIG. 2 is a comparative depiction of an elevation view of a polishing layer of a chemical mechanical polishing pad in an original state, a densified state and a partially recovered state.

In FIG. 2 there is provided a comparative depiction of an elevation view of a polishing layer of a shape memory chemical mechanical polishing pad. In particular, FIG. 2 provides a comparison of a polishing layer in an original state 30 with an original thickness, OT, to the same polishing layer in a densified state 40 with a densified thickness, DT, to the same polishing layer in a partially recovered state 50 with a total recovered thickness, TRT, and with the recovered portion proximate the polishing surface 32 having a recovered thickness, RT. The polishing layer depicted in FIG. 2 comprises a plurality of microelements 34 dispersed within a shape memory matrix material 36.

Figure 3:
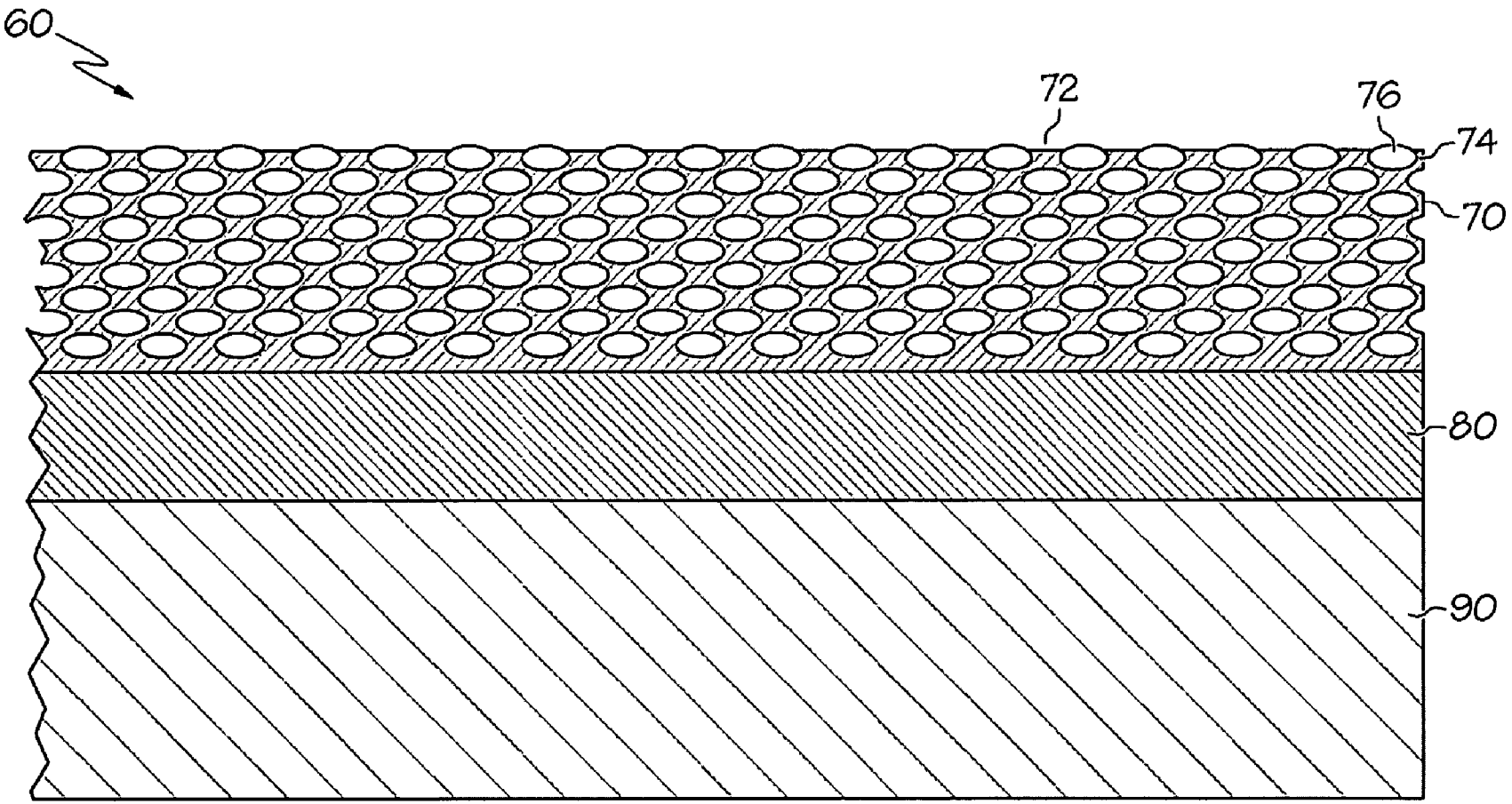
FIG. 3 is an elevation view of a shape memory chemical mechanical polishing pad.

In FIG. 3 there is provided an elevation view of a shape memory chemical mechanical polishing pad. In particular, the shape memory chemical mechanical polishing pad 60 in FIG. 3 comprises a polishing layer 70 with a polishing surface 72, wherein the polishing layer comprises a plurality of microelements 76 uniformly dispersed throughout a shape memory matrix material 74. The shape memory chemical mechanical polishing pad 60 in FIG. 3 further comprises a base layer 90 interfaced with the polishing layer 70. Specifically, the base layer 90 is adhered to the polishing layer 70 by an adhesive layer 80.

Figure 4:
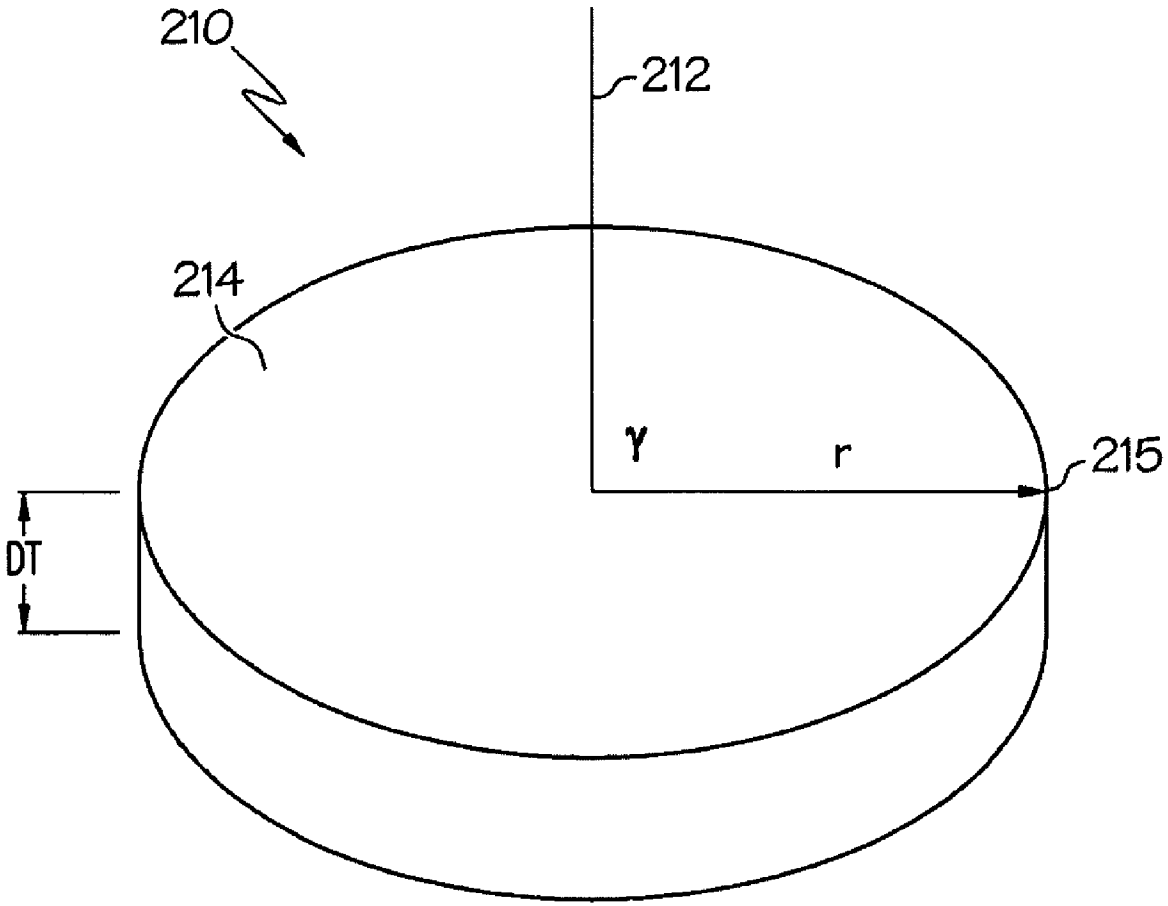
FIG. 4 is a side perspective view of a shape memory chemical mechanical polishing pad.

In FIG. 4 there is provided a side perspective view of a shape memory chemical mechanical polishing pad. In particular, FIG. 4 depicts a single layer shape memory chemical mechanical polishing pad 210 in a densified state having a densified thickness, DT. The shape memory chemical mechanical polishing pad 210 has a polishing surface 214 and a central axis 212. The polishing surface 214 has a substantially circular cross section with a radius r from the central axis 212 to the outer periphery of the polishing surface 215 in a plane at an angle $\gamma$ to the central axis 212.

Figure 5:
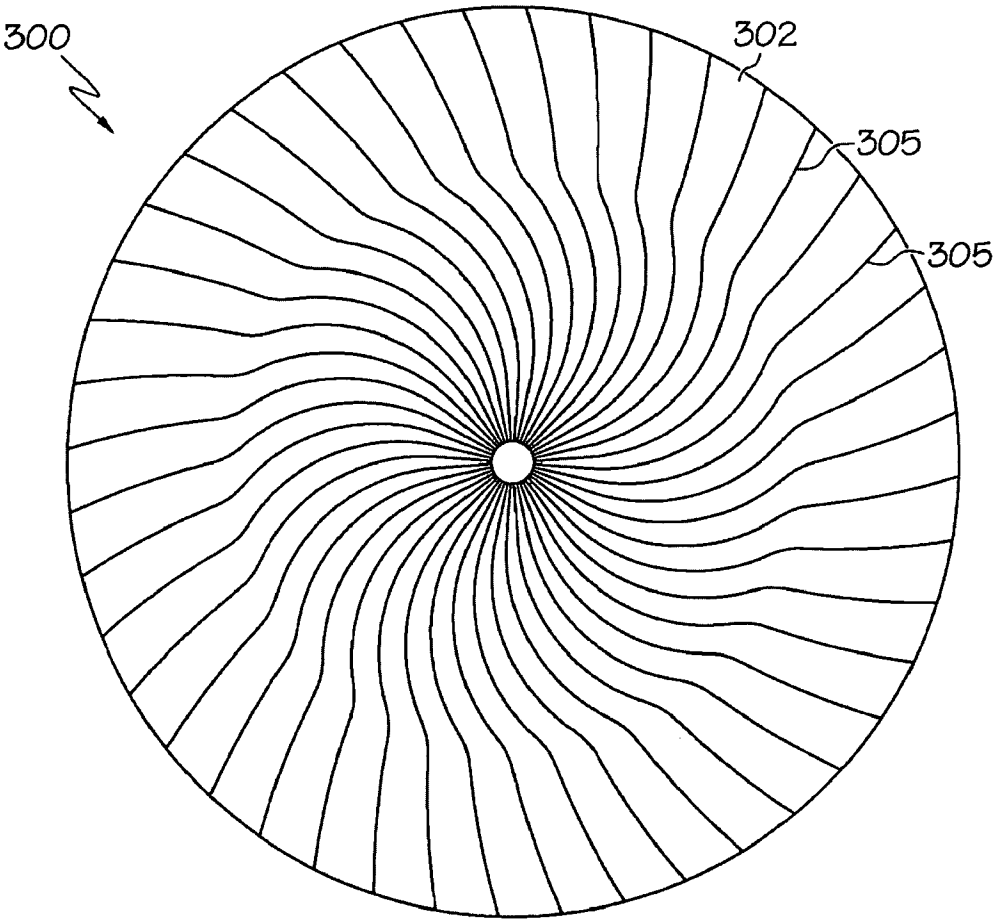
FIG. 5 is a top plan view of a shape memory chemical mechanical polishing pad depicting a groove pattern in the polishing surface.

In FIG. 5 there is provided a top plan view of a shape memory chemical mechanical polishing pad. In particular, FIG. 5 depicts a shape memory chemical mechanical polishing pad 300 having a polishing surface 302 with a groove pattern of a plurality of curved grooves 305.

Figure 6:
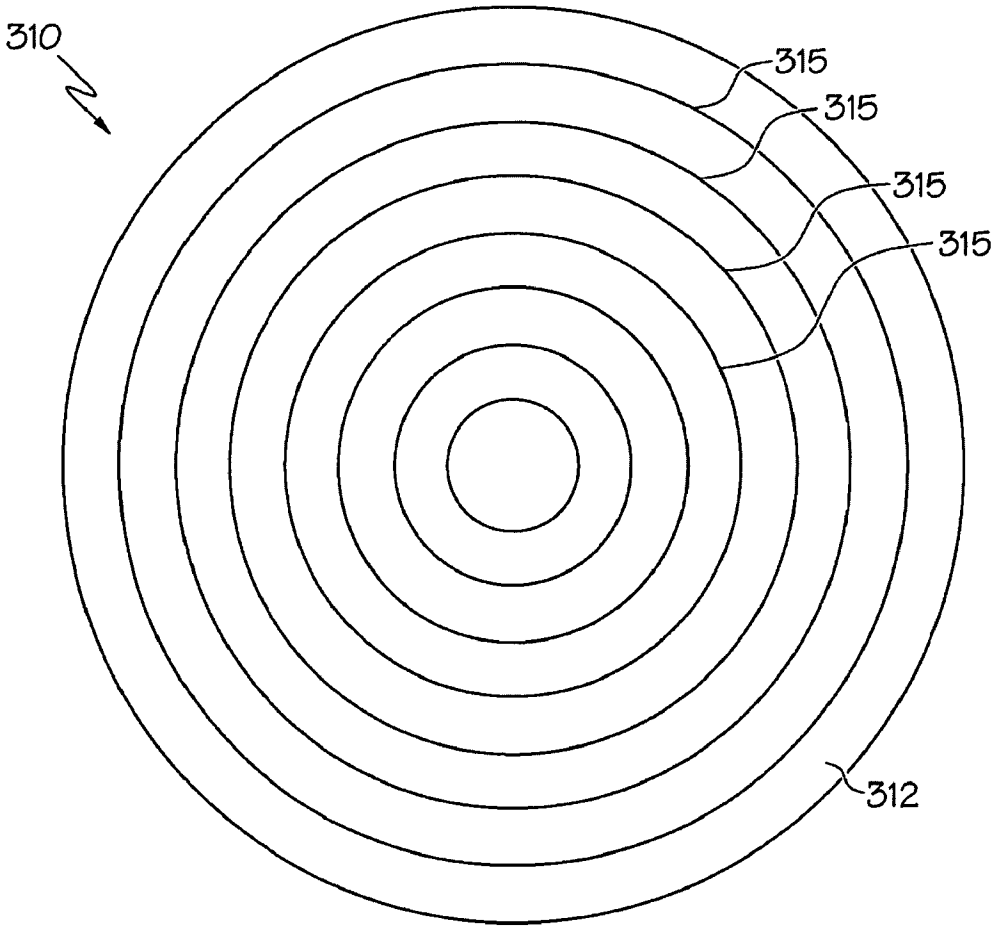
FIG. 6 is a top plan view of a shape memory chemical mechanical polishing pad depicting a groove pattern in the polishing surface.

In FIG. 6 there is provided a top plan view of a shape memory chemical mechanical polishing pad. In particular, FIG. 6 depicts a shape memory chemical mechanical polishing pad 310 having a polishing surface 312 with a groove pattern of a plurality of concentric circular grooves 315.

Figure 7:
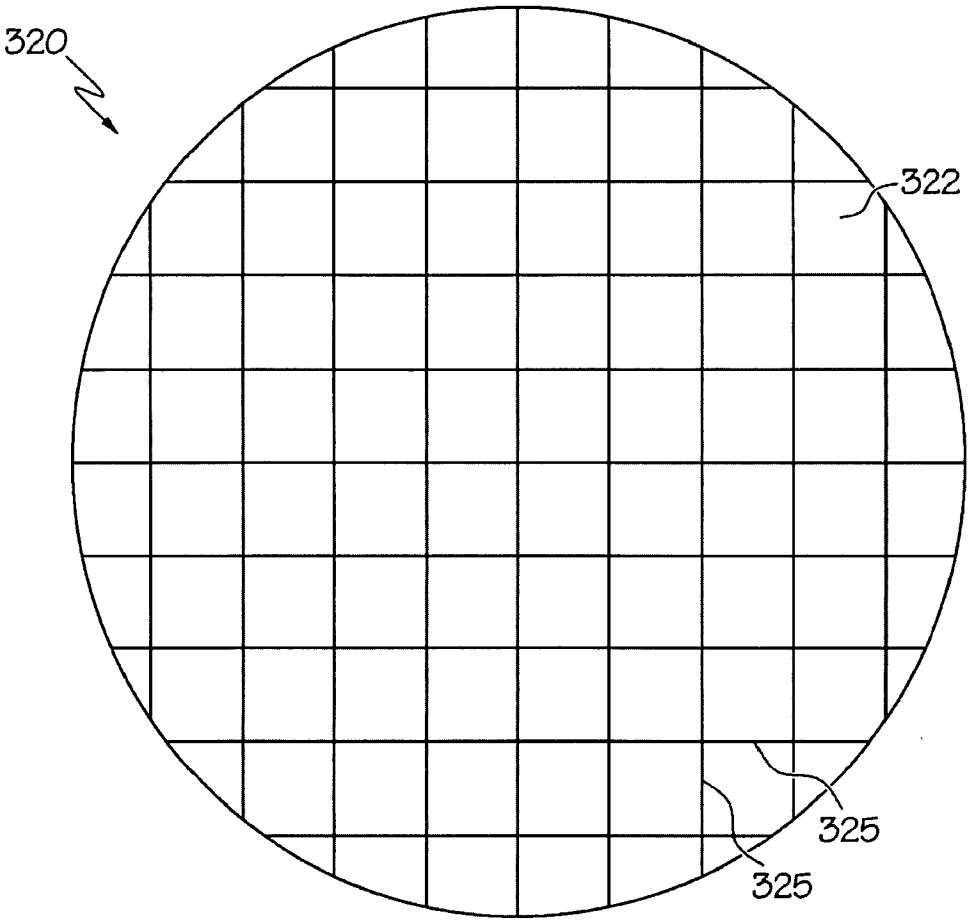
FIG. 7 is a top plan view of a shape memory chemical mechanical polishing pad depicting a groove pattern in the polishing surface.

In FIG. 7 there is provided a top plan view of a shape memory chemical mechanical polishing pad. In particular, FIG. 7 depicts a shape memory chemical mechanical polishing pad 320 having a polishing surface 322 with a groove pattern of a plurality of linear grooves 325 in an X-Y grid pattern.

Figure 8:
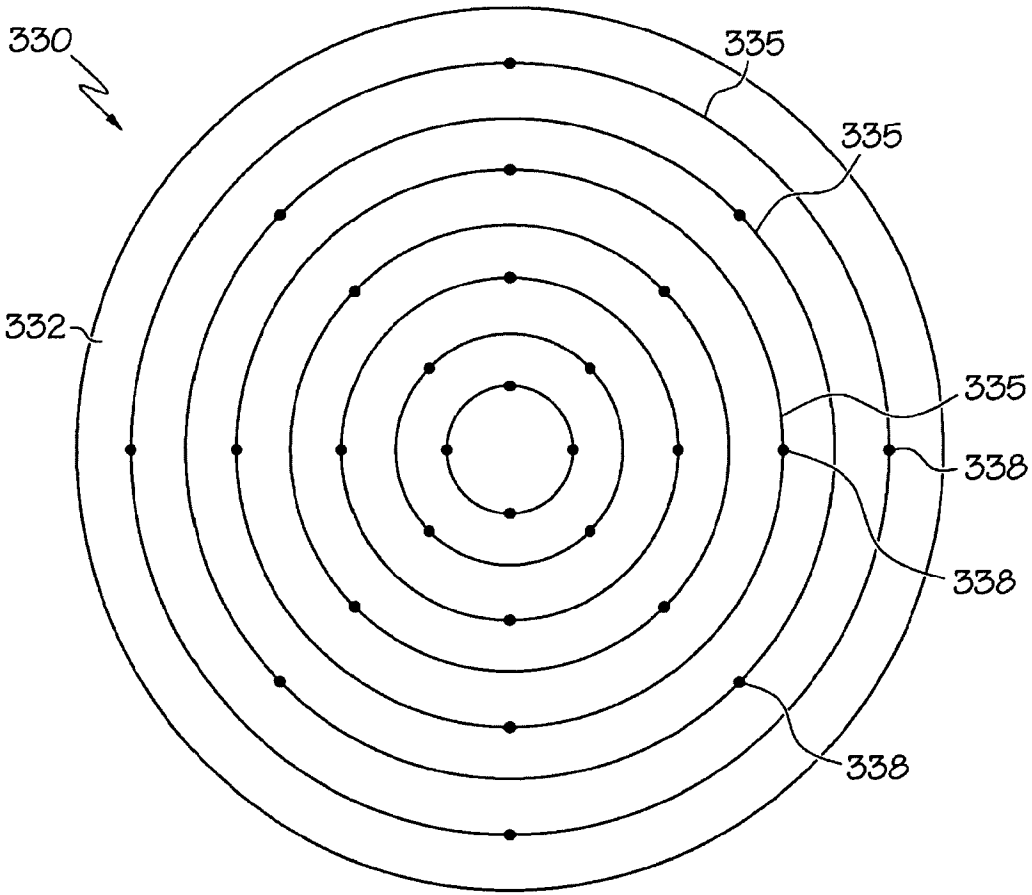
FIG. 8 is a top plan view of a shape memory chemical mechanical polishing pad depicting a combination of perforations and groove pattern in the polishing surface.

In FIG. 8 there is provided a top plan view of a shape memory chemical mechanical polishing pad. In particular, FIG. 8 depicts a shape memory chemical mechanical polishing pad 330 having a polishing surface 332 with a combination of a plurality of perforations 338 and a plurality of concentric circular grooves 335.

Figure 9:
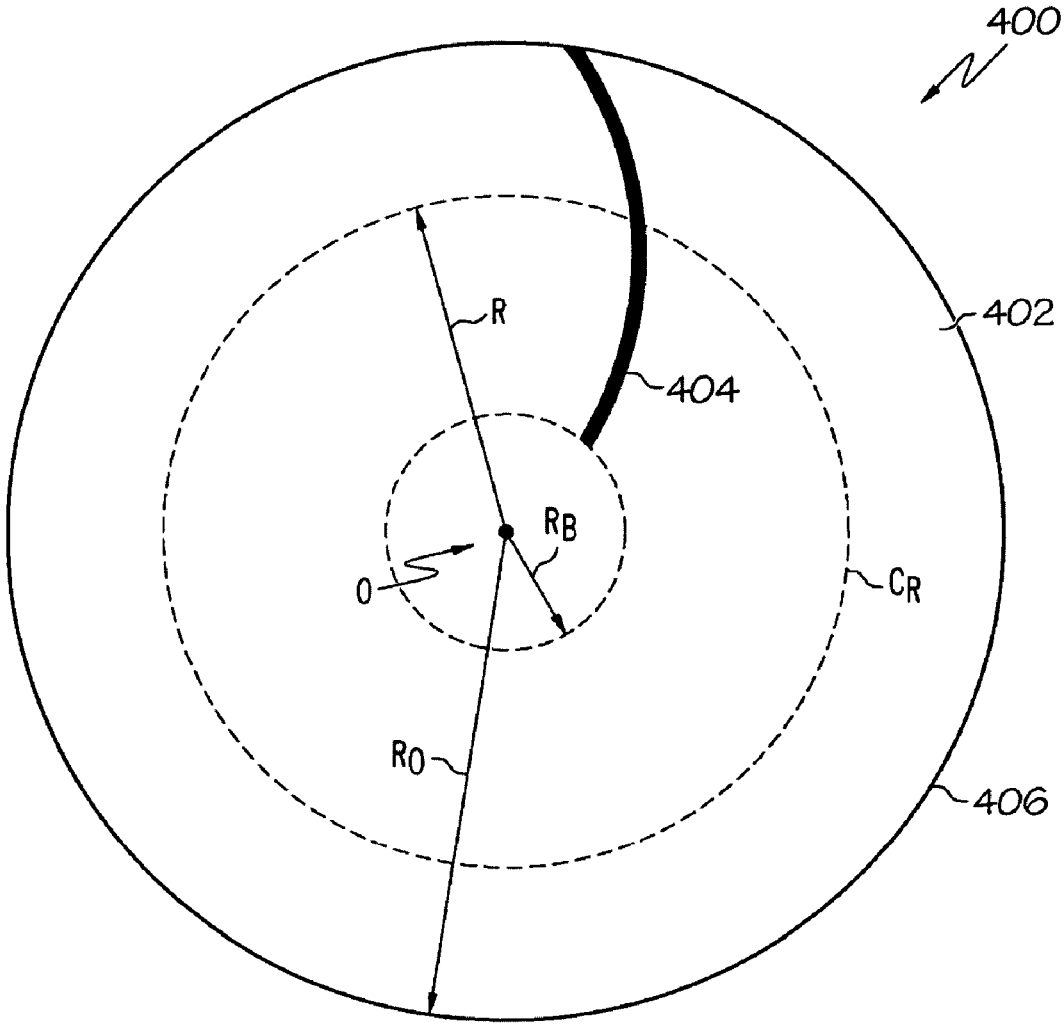
FIG. 9 is a top plan view of a shape memory chemical mechanical polishing pad of one embodiment of the present invention with a groove pattern in the polishing surface.
Figure 10:
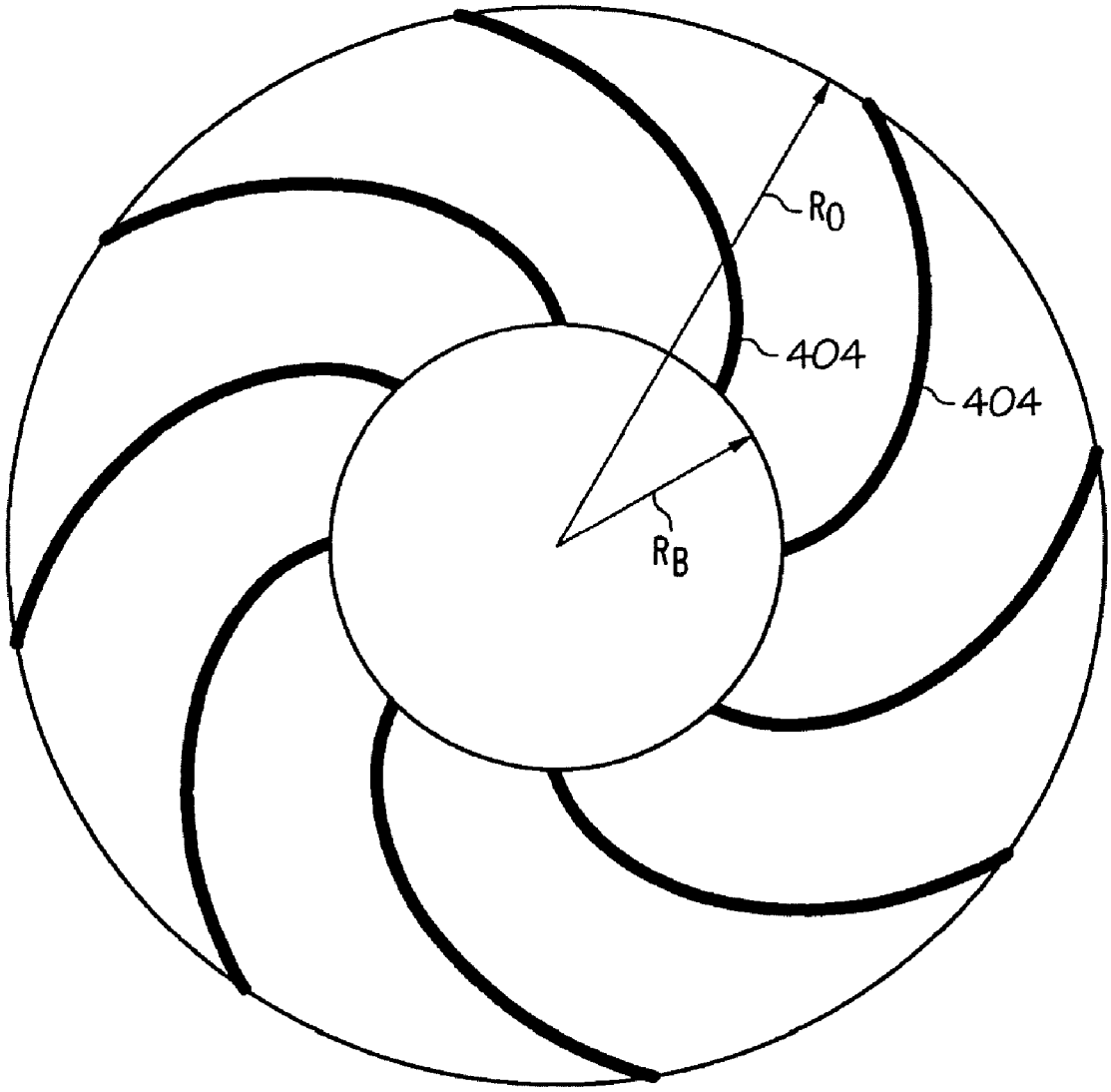
FIG. 10 is a top plan view of a shape memory chemical mechanical polishing pad of one embodiment of the present invention with a groove pattern in the polishing surface, wherein the polishing pad exhibits a 24 inch pad outer radius $R_O$ and a 10 inch base radius $R_B$; and 8 curved grooves.
Figure 11:
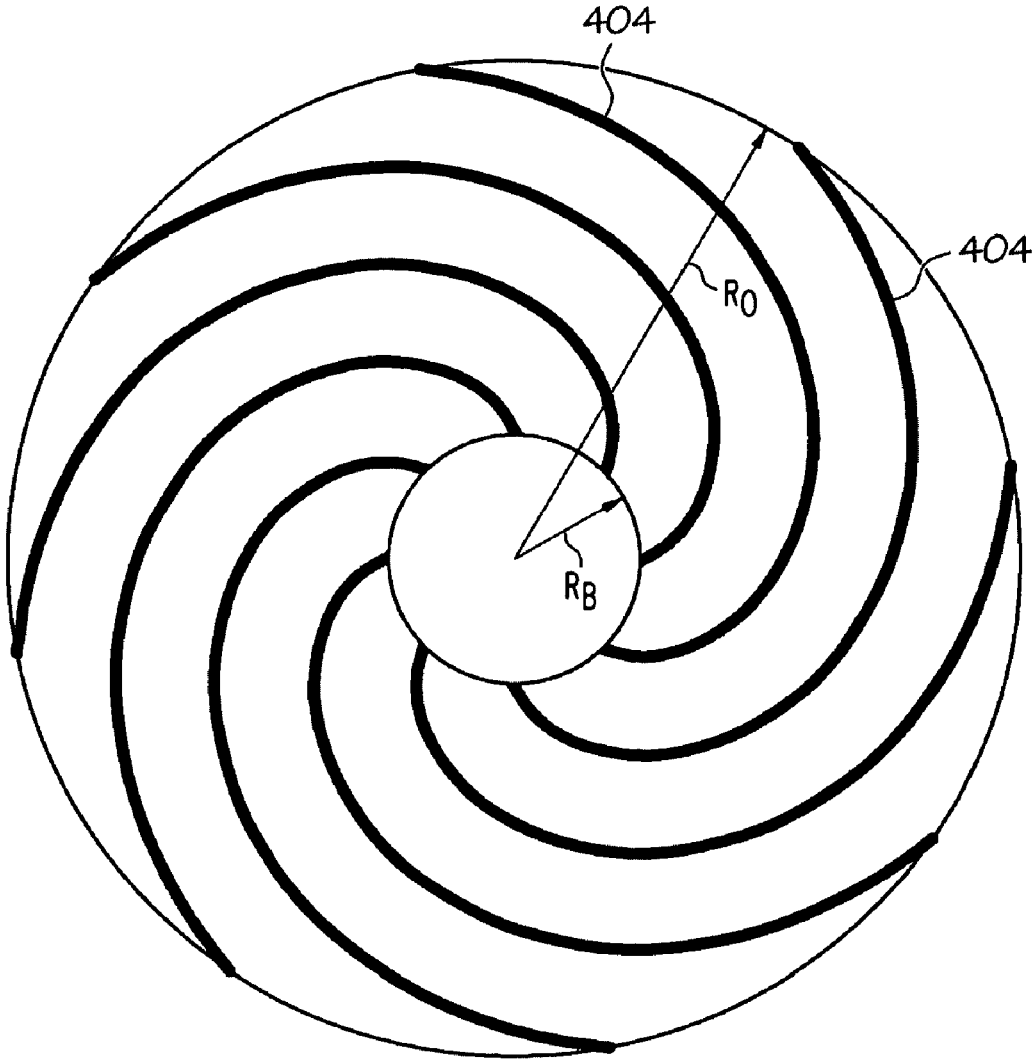
FIG. 11 is a top plan view of a shape memory chemical mechanical polishing pad of one embodiment of the present invention with a groove pattern in the polishing surface, wherein the polishing pad exhibits a 24 inch pad outer radius $R_O$; a 6 inch base radius $R_B$; and 8 curved grooves.
Figure 12:
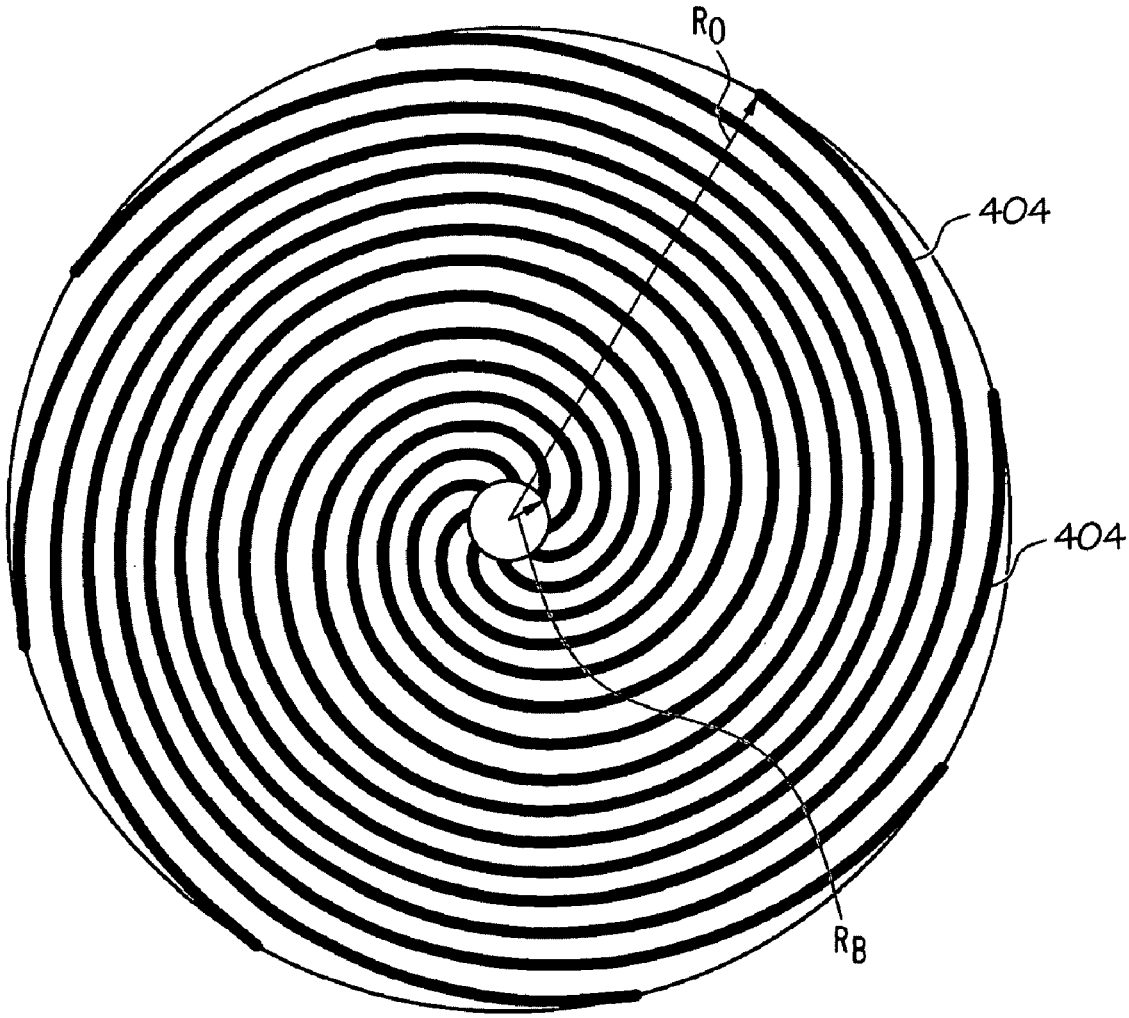
FIG. 12 is a top plan view of a shape memory chemical mechanical polishing pad of one embodiment of the present invention with a groove pattern in the polishing surface, wherein the polishing pad exhibits a 24 inch pad outer radius $R_O$ and a 2 inch base radius $R_B$.
Figure 13:
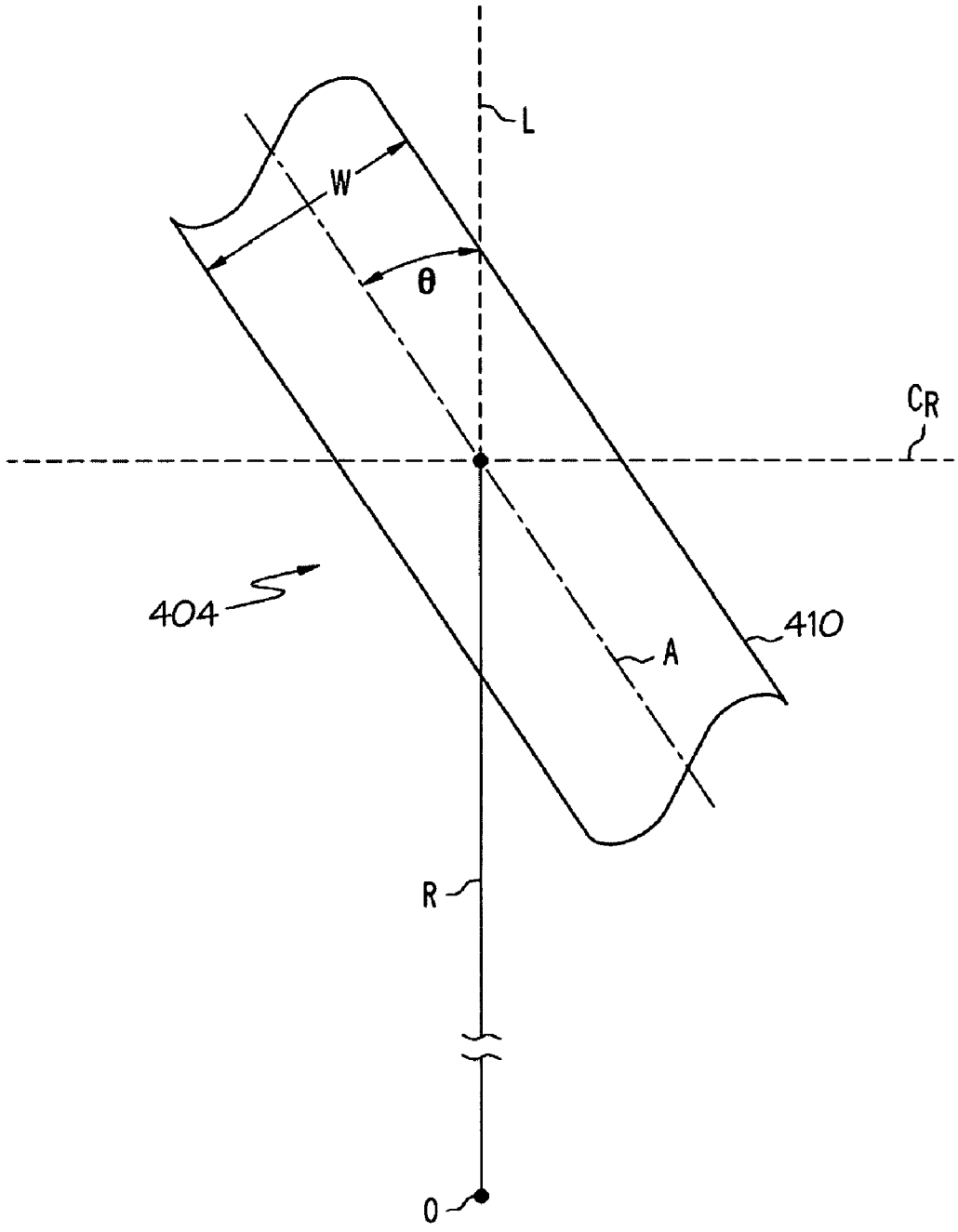
FIG. 13 is a close-up view of a groove segment of groove 404 of FIG. 9.

FIG. 9 provides a top plan view of a shape memory chemical mechanical polishing pad 400 of some embodiments of the present invention, wherein the polishing pad 400 has a macrotexture comprising a groove pattern that comprises at least one groove 404. The polishing pad 400 has an outer radius $R_O$ and a polishing surface 402 with at least one groove 404 formed therein. Although only a single groove 404 is depicted in FIG. 9, the groove pattern can comprise two or more grooves 404. (See, e.g., FIGS. 10-12). The polishing pad radius R is measured from an origin O at the center of the polishing surface 402. A circle $C_R$ (dashed line) drawn at radius R with a circumference $2\pi R$ is also shown in FIG. 9. The outer radius of polishing pad 400 is $R_O$. Groove 404 extends from base radius $R_B$ to outer radius $R_O$, which defines the outer periphery 406 of polishing surface 402. In some aspects of these embodiments, the groove(s) 404 extend from base radius $R_B$ to outer periphery 406 (as depicted in FIGS. 9-12). In some aspects of these embodiments, the groove(s) 404 extend from a point between the origin O and the base radius $R_B$ to outer periphery 406. In some aspects of these embodiments, the groove(s) 404 extend from origin O to outer periphery 406. FIG. 13 depicts a close-up view of a groove segment of groove 404 of FIG. 9, showing a small differential segment 410 of groove 404. At a given radius R, groove 404 has a given width W and a central axis A that forms an angle $\theta$ ("groove angle") with respect to a radial line L connecting the origin O to the given radius R. In some aspects of these embodiments, the shape memory chemical mechanical polishing pad has a macrotexture comprising a groove pattern, wherein CF remains within 25%, preferably within 10%, more preferably within 5% of its average value as a function of the polishing pad radius R in an area extending from an outer radius $R_O$ of the polishing surface a majority distance to origin O. In some aspects of these embodiments, the shape memory chemical mechanical polishing pad has a macrotexture comprising a groove pattern, wherein CF remains within 25%, preferably within 10%, more preferably within 5% of its average value as a function of polishing pad radius R in an area extending from base radius $R_B$ to outer radius $R_O$.

Figure 14:
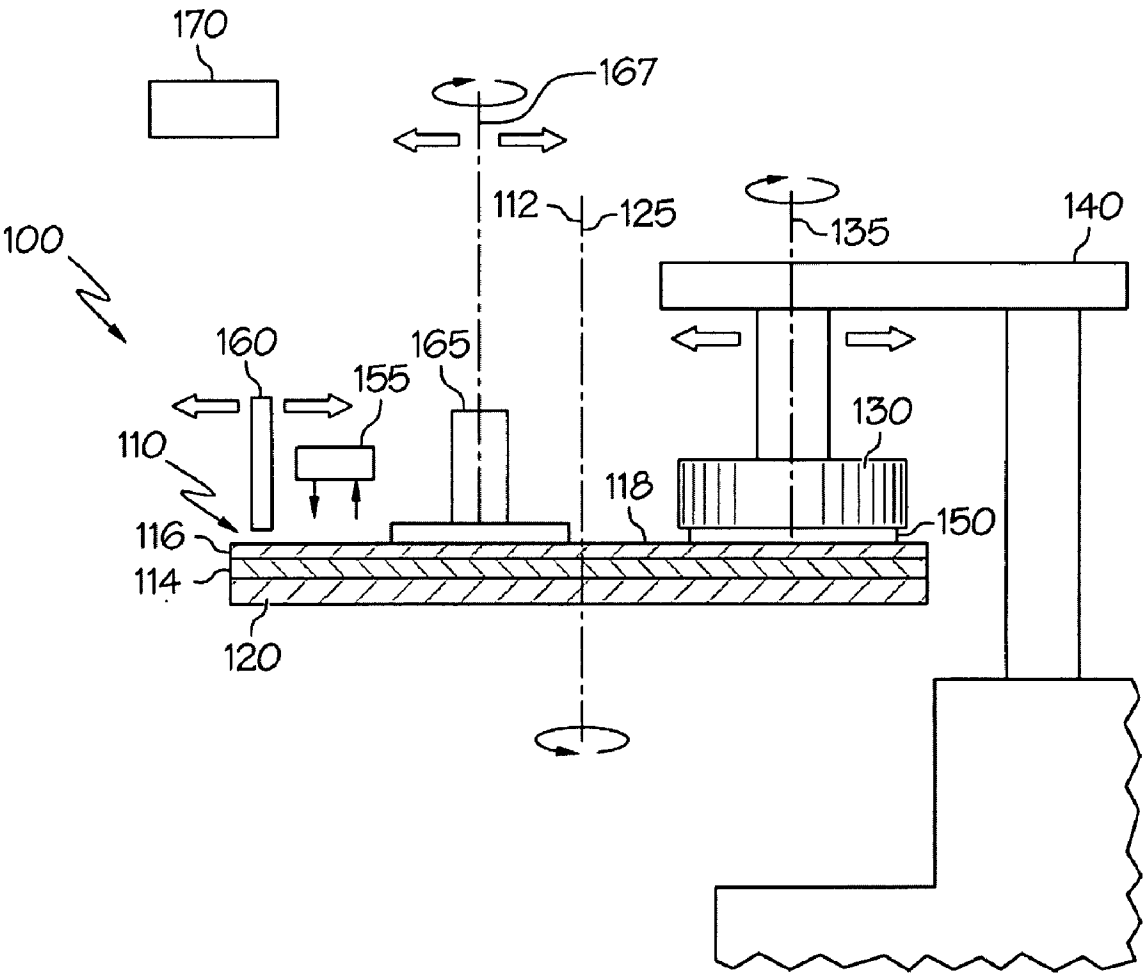
FIG. 14 is a depiction of a polishing machine utilizing a shape memory chemical mechanical polishing pad to polish a semiconductor wafer.

In FIG. 14 there is provided a depiction of a polishing machine utilizing a shape memory chemical mechanical polishing pad to polish a semiconductor wafer. In particular, FIG. 14 depicts a polishing apparatus 100 with a shape memory chemical mechanical polishing pad 110 having a central axis 112, a polishing layer 116 with a polishing surface 118 and a base layer 114. FIG. 14 further depicts a polishing platen 120 to which the base layer 114 is affixed. The polishing platen 120 has a central axis 125 that corresponds with the central axis 112 of the polishing pad 110. The polishing apparatus 100 further comprises a wafer carrier 130 having a central axis 135. The wafer carrier 130 carries semiconductor wafer 150. The wafer carrier 130 is mounted to a translational arm 140 for moving the wafer carrier laterally relative to the polishing pad 110. The wafer carrier 130 and the platen 120 (with polishing pad 110 attached thereto) are designed to move rotationally about their respective central axis and to facilitate dynamic contact between the polishing surface 118 and the semiconductor wafer 150. The monitor 155 is positioned (optionally moveably positioned) relative to the polishing surface to facilitate the measurement of at least one polishing pad property selected from a polishing pad thickness and a groove depth. The source 160 is moveably positioned in proximity to the polishing surface 118 to facilitate the selective exposure of the polishing layer to an activating stimulus such that the exposed portion of the polishing layer transitions from a densified state to a recovered state. The conditioning apparatus 165 with a central axis 167 provides abrasive conditioning for the polishing surface 118. The controller 170 is in active communication with the monitor 155, the source 160 and the conditioning apparatus 165; and is programmed to maintain a consistent polishing pad thickness and/or groove depth.

Figure 15:
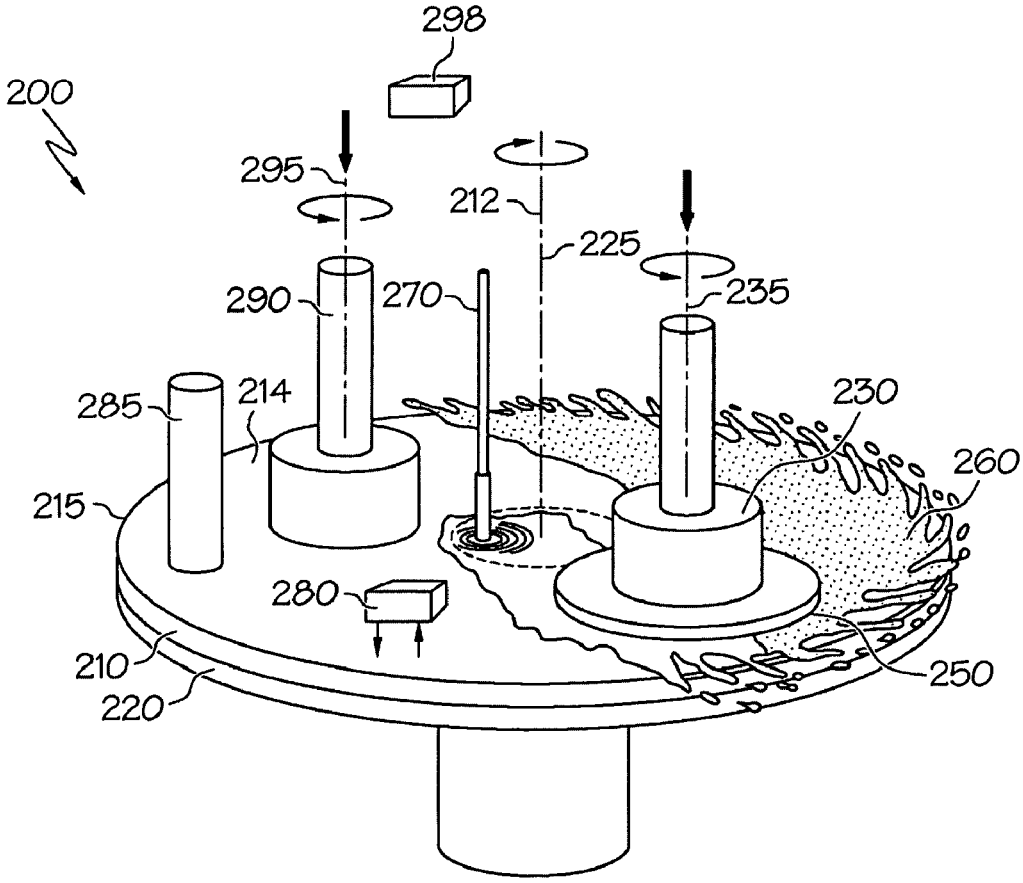
FIG. 15 is a depiction of a polishing apparatus utilizing a shape memory chemical mechanical polishing pad in combination with a polishing slurry to polish a semiconductor wafer.

In FIG. 15 there is provided a depiction of a polishing apparatus utilizing a shape memory chemical mechanical polishing pad in combination with a polishing medium. In particular, FIG. 15 depicts an apparatus 200 comprising a single layer shape memory chemical mechanical polishing pad 210 with a polishing surface 214 and an outer periphery 215. The polishing pad 210 is interfaced with a platen 220. The polishing pad 210 has a central axis 212 which corresponds with a central axis 225 of the platen 220. The apparatus 200 further comprises a wafer carrier 230 with a central axis 235. The wafer carrier 230 holds a semiconductor wafer 250. The apparatus 200 further comprises a polishing medium 260 and a slurry dispenser 270 for dispensing the polishing medium onto the polishing surface 214. During polishing of the semiconductor wafer 250, the platen 220 and the polishing pad 210 are rotated about their respective central axis and the wafer carrier is rotated about its central axis. During polishing, the polishing pad and the wafer are placed in dynamic contact with one another and the polishing medium is introduced to the system such that it may pass between the semiconductor wafer and the polishing surface of the polishing pad. The monitor 280 is positioned (optionally moveably positioned) relative to the polishing surface to facilitate the measurement of at least one polishing pad property selected from a polishing pad thickness and a groove depth. The source 285 is moveably positioned in proximity to the polishing surface 214 to facilitate the selective exposure of the polishing layer to an activating stimulus such that the exposed portion of the polishing layer transitions from a densified state to a recovered state. The conditioning apparatus 290 with central axis 295 provides abrasive conditioning for the polishing surface 214. The controller 298 is in active communication with the monitor 280, the source 285 and the conditioning apparatus 290; and is programmed to maintain a consistent polishing pad thickness and/or groove depth.

Some embodiments of the present invention will now be described in detail in the following Examples.

EXAMPLE 1

Shape Memory Polishing Pad

Test samples were prepared from a commercially available filled polyurethane polishing pad (available from Rohm and Haas Electronic Materials CMP Inc. as IC1000™). The test samples comprised circular discs with a diameter of about 12.7 mm which were die-stamped out of the IC1000™ pad.

EXAMPLE 2

Shape Memory Polishing Pad Material Preparation

A shape memory matrix material was prepared by mixing at about 50° C. and atmospheric pressure: 227 grams of glycerol propoxylate (average $M_n$~266); 279 grams of polytetrahydrofuran (average $M_n$~650); and, 494 grams of polycarbodiimide-modified diphenylmethane diisocyanate (available from The Dow Chemical Company as Isonate® 143L). To this mixture was then blended 18 grams of hollow elastic polymeric microspheres (available from Akzo Nobel as Expancel° 551DE) at 2000 rpm using a non-contact planetary high shear mixer to evenly distribute the microspheres in the shape memory matrix material. The final mixture was then poured between two flat glass surfaces 2.54 mm apart and the ~254 mm diameter pour sheet formed was permitted to gel for about 10 minutes. The 2.54 mm thick pour sheet along with the glass surfaces was then placed in a curing oven and cured for about 16-18 hours at about 105° C. The cured sheet was then cooled for about 8 hours at room temperature until the sheet temperature was about 25° C.

EXAMPLE 3

Shape Memory Polishing Pad Material Preparation

A shape memory matrix material was prepared by mixing at about 50° C. and atmospheric pressure: 216 grams of glycerol propoxylate (average $M_n$~266); 315 grams of poly (caprolactone) diol (average $M_n$~775); and, 469 grams of polycarbodiimide-modified diphenylmethane diisocyanate (available from The Dow Chemical Company as Isonate® 143L). To this mixture was then blended 18 grams of hollow elastic polymeric microspheres (available from Akzo Nobel as Expancel® 551DE) at 2000 rpm using a non-contact planetary high shear mixer to evenly distribute the microspheres in the shape memory matrix material. The final mixture was then poured between two flat glass surfaces 2.54 mm apart and the ~254 mm diameter pour sheet formed was permitted to gel for about 10 minutes. The sheet was cured as in Example 2.

EXAMPLE 4

Storage Modulus vs. Temperature Measurements

Figure 16:
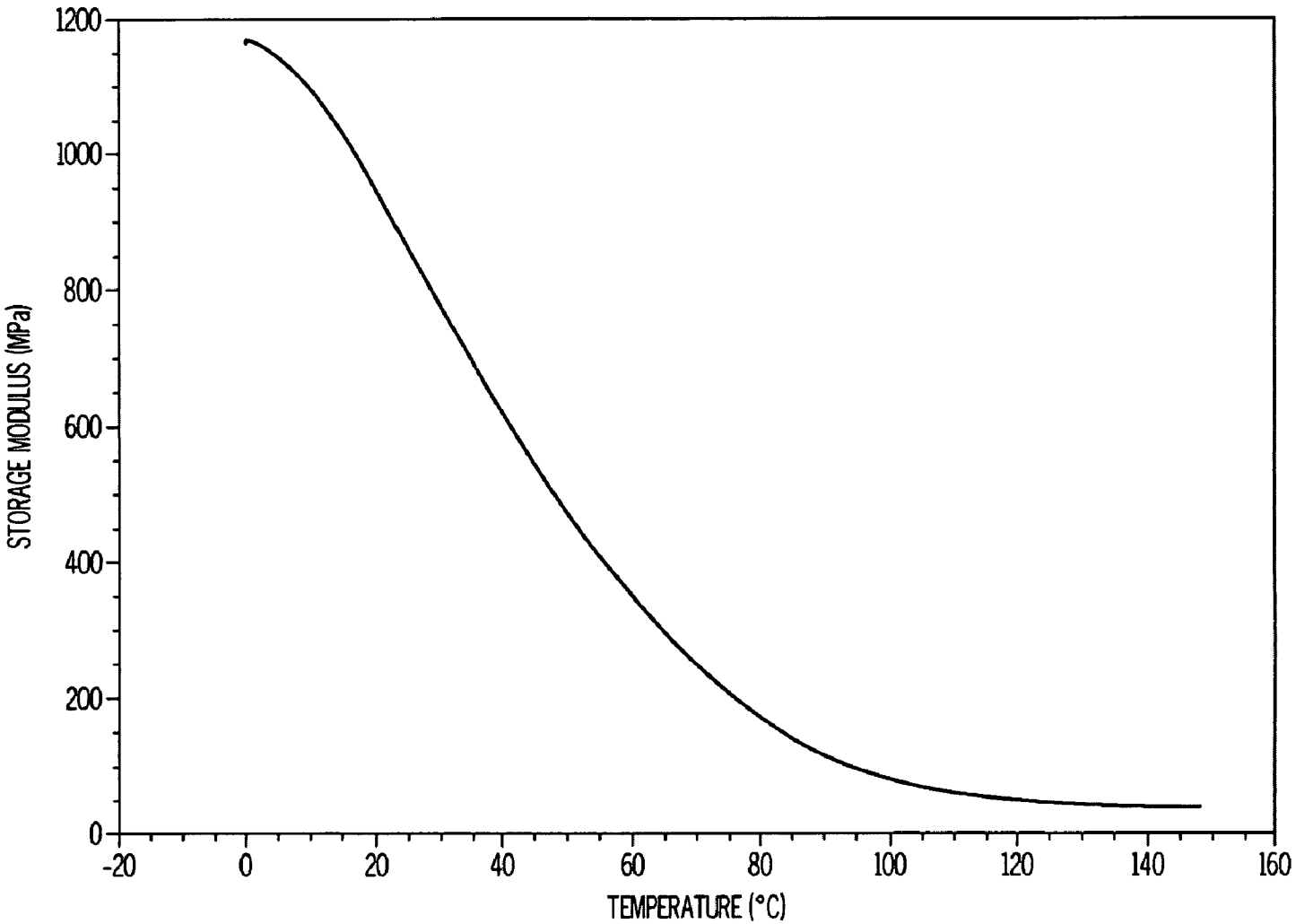
FIG. 16 is a graph providing a storage modulus versus temperature curve for the composition used in commercial IC1000™ polishing pads.

A storage modulus in (MPa) versus temperature in (° C.) curve was plotted for the shape memory matrix material used in commercial IC1000™ polishing pads from Rohm and Haas Electronic Materials CMP Inc. (but without addition of Expancel® material) using a dynamic mechanical analyzer (DMA, TA Instruments Q800 model). The plotted curve is provided in FIG. 16.

EXAMPLE 5

Storage Modulus vs. Temperature Measurements

Figure 17:
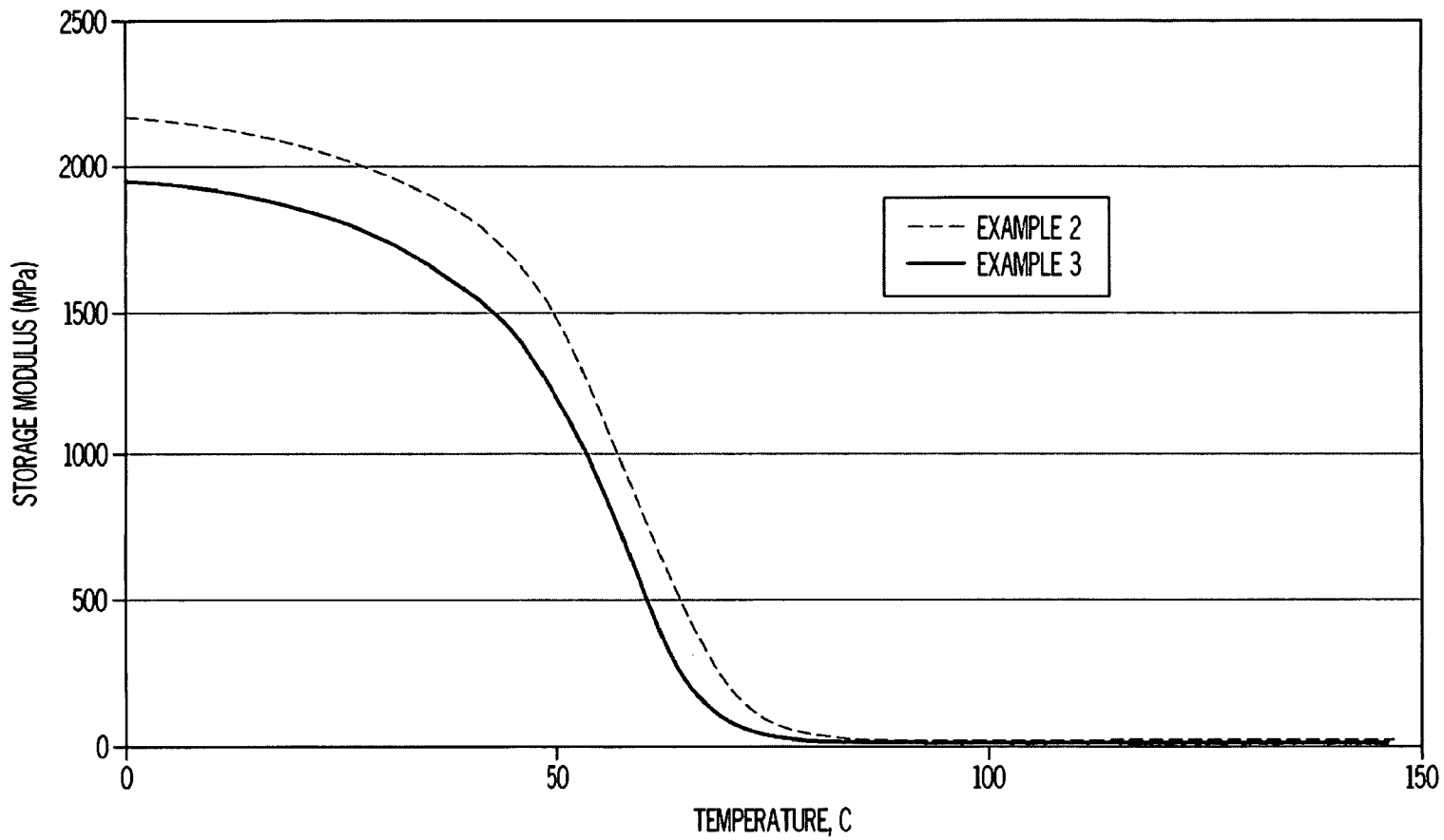
FIG. 17 is a graph providing storage modulus versus temperature curves for two shape memory matrix materials.

Storage modulus in (MPa) versus temperature in (° C.) was plotted for the shape memory matrix materials prepared as in Examples 2 and 3 (but without addition of Expancel® material) using a mechanical analyzer (DMA, TA Instruments Q800 model). The plotted curves are provided in FIG. 17.

EXAMPLE 6

Shape Memory Matrix Material Preparation

A shape memory matrix material was prepared by mixing (at about 50° C. and atmospheric pressure): 175 grams of glycerol propoxylate (average $M_n$~266); 349 grams of polycaprolactone (average $M_n$~530-b-530); and, 476 grams of polycarbodiimide-modified diphenylmethane diisocyanate (available from The Dow Chemical Company as Isonate® 143L).

EXAMPLE 7

Storage Modulus vs Temperature Measurement

Figure 18:
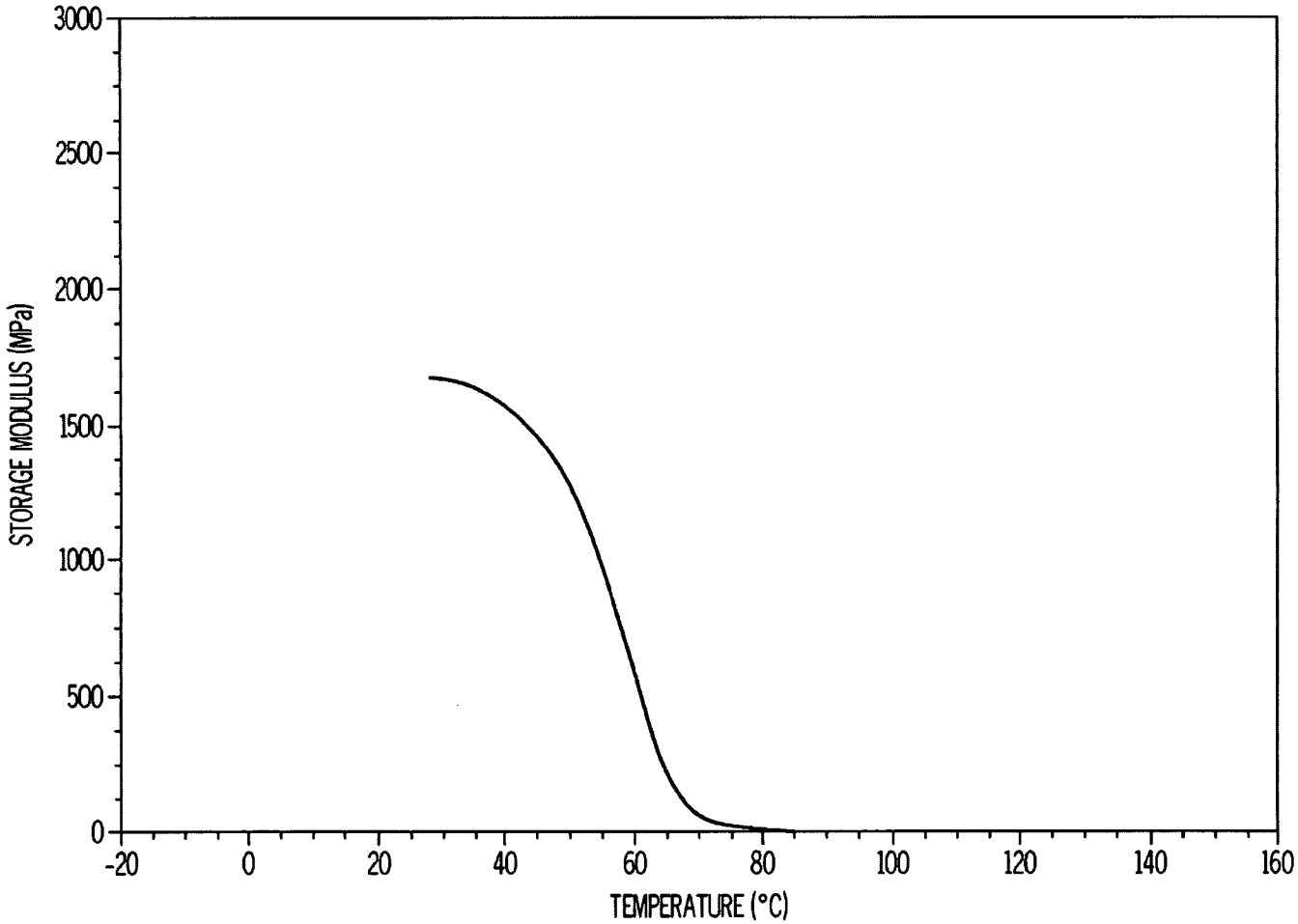
FIG. 18 is a graph providing storage modulus versus temperature curves for another shape memory matrix material.

Storage modulus in (MPa) versus temperature in (° C.) was plotted for the shape memory matrix material prepared as in Example 6 using a mechanical analyzer (DMA, TA Instruments Q800 model). The plotted curve is provided in FIG. 18.

EXAMPLE 8

Preparation of Polishing Pad in Densified State

Sample shape memory chemical mechanical polishing pad samples prepared according to Example 1 were placed between a 2" diameter top and bottom platens of an Instron Tester. A heated chamber, whose inside temperature was controllable, enclosed the space spanning the platens and the sample pads. The sample pads were heated to 120° C. for 20 minutes and an axial force was applied to the sample pads using the platens. This axial force imposed a nominal pressure on the sample pads, sufficient to compress the sample pads to about 50% of there original thickness. The nominal pressure imposed on the sample pads was around 1,000-5,000 psi. While maintaining the pressure, the sample pads were cooled to room temperature setting the shape memory matrix material therein to a programmed shape and providing the sample pads in a densified state.

EXAMPLE 9

Providing Polishing Pads in Densified State 12.5 mm diameter sample pads were punched out of the sheets produced according to Examples 2 and 3. The sample pads were then placed between the 2" diameter top and bottom platens of an Instron Tester. A heated chamber, whose inside temperature was controllable, enclosed the space spanning the platens and the sample pads. The sample pads were then heated to 90° C. for 20 minutes and an axial force was applied to the sample pads using the platens. This axial force imposed a nominal pressure on the sample pads, sufficient to compress the sample pads to about 50% of there original thickness. The pressure imposed on the sample pads by the axial force was around 1,000-5,000 psi. While maintaining this imposed pressure, the sample pads were cooled to room temperature, setting the shape memory material in the sample pads in a programmed state and providing sample pads in a densified state.

EXAMPLE 10

Recovery of Polishing Pads to Recovered State

The polishing pad samples in a densified state prepared according to Example 8 were heated in an oven at 120° C. for 10-20 minutes. The thickness of each of the polishing pad samples was then measured. Each of the polishing pad samples were observed to have transitioned to a recovered state with a maximum total recovered thickness of >99% of their original thickness.

EXAMPLE 11

Recovery of Polishing Pads to Recovered State

The polishing pad samples in a densified state prepared according to Example 9 were heated in an oven at 90° C. for 10-20 minutes. The thickness of each of the polishing pad samples was then measured. Each of the polishing pad samples were observed to have transitioned to a recovered state with a maximum total recovered thickness of >99% of their original thickness.

EXAMPLE 12

Recovery of Pad Thickness and Groove Depth

Figure 19:
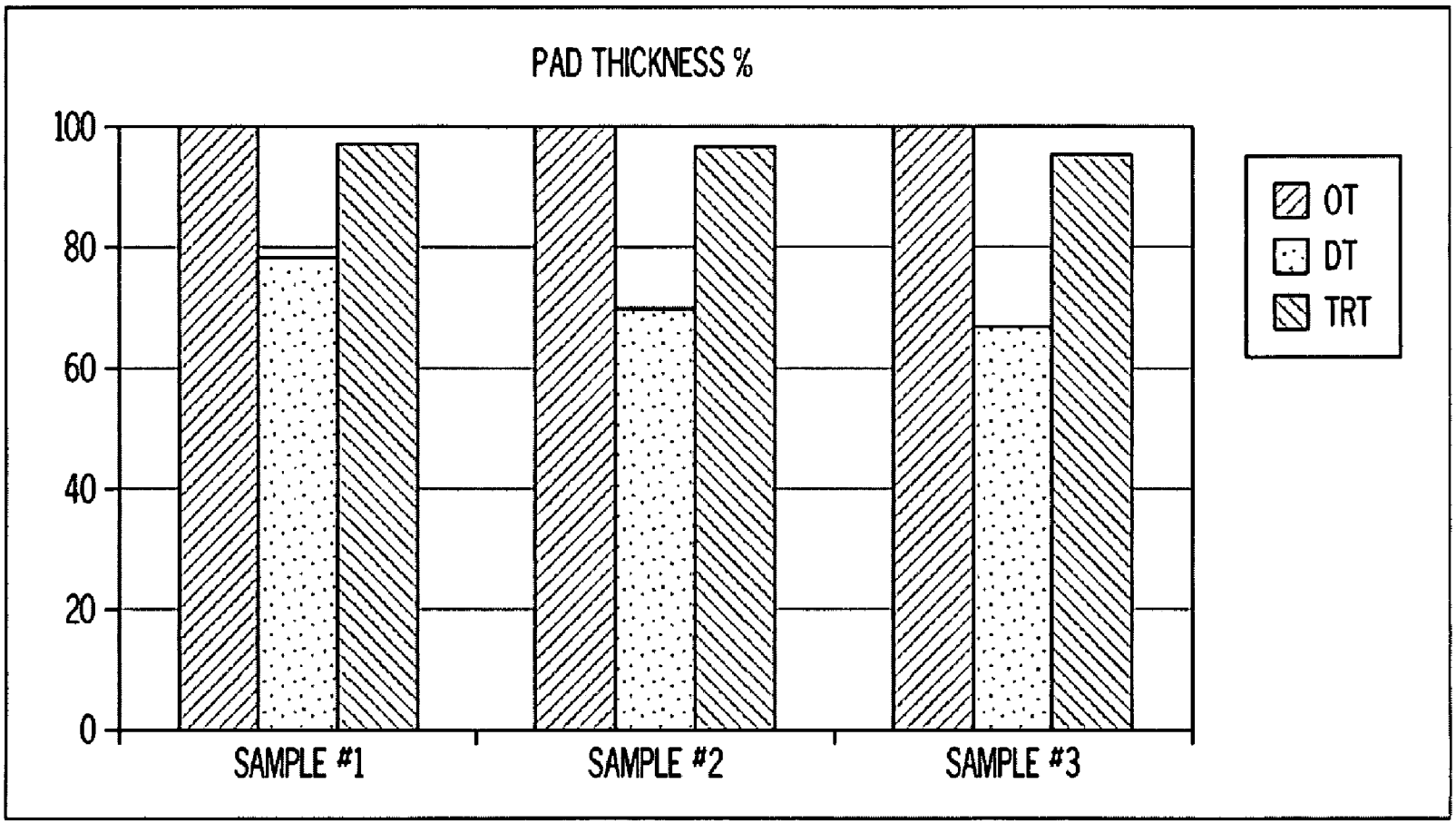
FIG. 19 is a bar graph showing the original thickness (OT), densified thickness (DT), and total recovered thickness (TRT) for three different test samples prepared from an IC1010™ polishing pad available from Rohm and Haas Electronic Materials CMP Inc.
Figure 20:
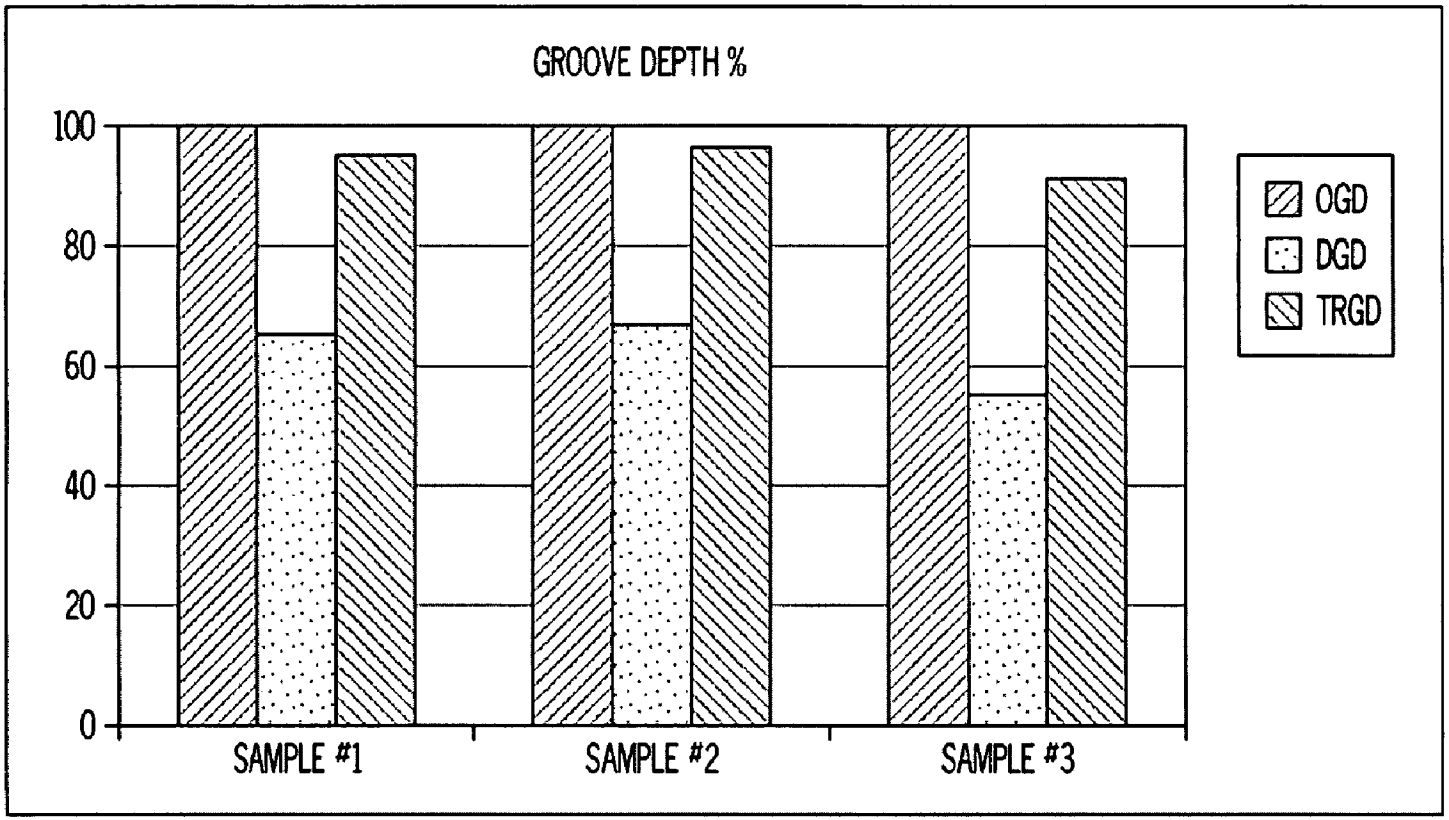
FIG. 20 is a bar graph showing the original groove depth (OGD), densified groove depth (DGD), and total recovered groove depth (TRGD) for three different test samples prepared from an IC 1010™ polishing pad available from Rohm and Haas Electronic Materials CMP Inc.

Three test samples were prepared from a commercially available filled polyurethane polishing pad (available from Rohm and Haas Electronic Materials CMP Inc. as IC1010™ with circular grooves cut in). The test samples comprised circular discs with a diameter of about 12.7 mm which were die-stamped out of the IC1010™ pad. Each of these 12.7 mm diameter samples had portions of circular grooves from the original pad. These samples were compressed according to the method described in Example 8 and recovered according to the method described in Example 10. Measurements of the sample thickness and depth of the grooves were made on the individual samples at each of the following states: before compression, original thickness (OT) and original groove depth (OGD), respectively; after compression, densified thickness (DT) and densified groove depth (DGD), respectively; and, after recovery, total recovered thickness (TRT) and total recovered groove depth (TRGD), respectively. Both thickness and groove depth were measured using an optical microscope. The data are shown in graphical form in FIGS. 19 and 20. Note that the sample thickness and the groove depth presented in FIGS. 19 and 20 have been normalized using the respective original values before compression. The data indicate that for various levels of compression, the TRT is ≧95% of the OT and the TRGD is ≧91% of the OGD.

We claim:

1. A method of polishing a substrate, comprising:

providing a substrate selected from at least one of a magnetic substrate, an optical substrate and a semiconductor substrate;

providing a shape memory chemical mechanical polishing pad having a pad thickness, PT; wherein the polishing pad comprises a polishing layer set in a densified state, wherein the polishing layer comprises a shape memory matrix material having an original shape and a programmed shape; wherein the polishing layer exhibits an original thickness, OT, when the shape memory matrix material is in its original shape; wherein the polishing layer exhibits a densified thickness, DT, in the densified state when the shape memory matrix material is set in the programmed shape; wherein the DT is <80% of the OT;

creating dynamic contact between a polishing surface of the polishing layer and the substrate to polish a surface of the substrate;

monitoring at least one polishing pad property selected from a polishing pad thickness and at least one groove depth; and, exposing at least a portion of the polishing layer proximate the polishing surface to an activating stimulus;

wherein the portion of the polishing layer proximate the polishing surface exposed to the activating stimulus transitions from the densified state to a recovered state.

2. The method of claim 1, further comprising:

conditioning the polishing surface of the polishing layer, wherein the conditioning is abrasive conditioning.

3. The method of claim 1, further comprising:

providing a controller;

providing a measuring device capable of monitoring the at least one polishing pad property;

providing a source capable of creating the activating stimulus;

wherein the at least one polishing pad property for at least a portion of the polishing pad is decreased following the dynamic contact with the substrate; wherein the measuring device and the source communicate with the controller; wherein the measuring device inputs information to the controller regarding the at least one polishing pad property; and wherein the controller controls the source based on the information input from the measuring device, facilitating the selective exposure of at least a portion of the polishing pad to the activating stimulus, such that the at least one polishing pad property is increased.

4. The method of claim 1, wherein the activating stimulus is selected from exposure to heat, light, a magnetic field, an electric field, water, pH, and combinations thereof.

5. A method of polishing a substrate, comprising:

providing a substrate selected from at least one of a magnetic substrate, an optical substrate and a semiconductor substrate;

providing a shape memory chemical mechanical polishing pad having a pad thickness, PT; wherein the polishing pad comprises a polishing layer set in a densified state, wherein the polishing layer comprises a shape memory matrix material having an original shape and a programmed shape; wherein the polishing layer exhibits an original thickness, OT, when the shape memory matrix material is in its original shape; wherein the polishing layer exhibits a densified thickness, DT, in the densified state when the shape memory matrix material is set in the programmed shape; wherein the DT is <80% of the OT;

providing a controller;

providing a measuring device capable of monitoring at least one polishing pad property selected from a polishing pad thickness and at least one groove depth;

providing a source capable of creating an activating stimulus;

creating dynamic contact between a polishing surface of the polishing layer and the substrate to polish a surface of the substrate;

monitoring the at least one polishing pad property; and, exposing at least a portion of the polishing layer proximate the polishing surface to the activating stimulus;

wherein the at least one polishing pad property for at least a portion of the polishing pad is decreased following the dynamic contact with the substrate; wherein the measuring device and the source communicate with the controller; wherein the measuring device inputs information to the controller regarding the at least one polishing pad property; and wherein the controller controls the source based on the information-input from the measuring device, facilitating a selective exposure of the at least a portion of the polishing pad to the activating stimulus, such that the at least one polishing pad property is increased.

6. The method of claim 5, further comprising:

conditioning of the polishing surface, wherein the conditioning is abrasive conditioning.

7. The method of claim 1, wherein the polishing pad property is maintained within ±5% of its initial value over multiple polishing operations.

8. The method of claim 1, further comprising:

providing a polishing medium at an interface between the polishing surface and the surface of the substrate.

9. The method of claim 1, wherein the substrate comprises a series of patterned semiconductor wafers.

10. The method of claim 1, wherein the shape memory matrix material has a glass transition temperature, $T_g$, measured by differential scanning calorimetry; wherein the portion of the polishing layer exposed to the activating stimulus exhibits a temperature of ≧the $T_g$ temperature for the shape memory matrix material.

* * * * *